US007556444B2

(12) United States Patent
Kurashina et al.

(10) Patent No.: US 7,556,444 B2
(45) Date of Patent: Jul. 7, 2009

(54) EMBOSSING CONTROL METHOD, PROGRAM, BRAILLE-EMBOSSING APPARATUS, AND CHARACTER-INFORMATION-PROCESSING APPARATUS

(75) Inventors: Hiroyasu Kurashina, Matsumoto (JP); Junichi Kikuchi, Saitama (JP); Takayuki Uehara, Koshigara (JP)

(73) Assignees: Seiko Epson Corporation, Tokyo (JP); King Jim Co., Ltd., Tokyo (JP)

( * ) Notice: Subject to any disclaimer, the term of this patent is extended or adjusted under 35 U.S.C. 154(b) by 581 days.

(21) Appl. No.: 11/319,831

(22) Filed: Dec. 28, 2005

(65) Prior Publication Data

US 2006/0153619 A1 Jul. 13, 2006

(30) Foreign Application Priority Data

Jan. 7, 2005 (JP) ..... 2005-002988

(51) Int. Cl.
*B41J 3/32* (2006.01)

(52) U.S. Cl. ..... 400/109.1; 400/621; 400/483; 400/134.1; 400/134.4; 400/127

(58) Field of Classification Search ..... 400/109, 400/109.1, 134.1, 134.4, 483; 101/4
See application file for complete search history.

(56) References Cited

U.S. PATENT DOCUMENTS 5,627,578 A * 5/1997 Weintraub ..... 347/101
5,639,540 A * 6/1997 Imaeda ..... 428/195.1
5,779,482 A * 7/1998 Fukumoto ..... 434/113
6,086,273 A * 7/2000 Hong ..... 400/109.1

FOREIGN PATENT DOCUMENTS

| | | |
|---|---|---|
| JP | 2001-088358 | 3/2001 |
| JP | 2003-182158 | 7/2003 |
| JP | 2004-230767 | 8/2004 |

OTHER PUBLICATIONS

Machine Translation of JP-2001-088358A.*

* cited by examiner

*Primary Examiner*—Leslie J Evanisko
*Assistant Examiner*—Matthew G Marini
(74) *Attorney, Agent, or Firm*—Hogan & Hartson LLP

(57) ABSTRACT

An embossing control method used in a braille-embossing apparatus includes an embossing head that embosses a braille string on a tape fed along a tape-conveying path, the braille string being embossed in an area biased to one of upper and lower sides of the tape along the width of the tape without changing the upper and lower direction of the braille string. The embossing control method includes the steps of designating the area biased to one of the upper and lower sides of the tape along the width of the tape as a braille-embossing area in which braille embossing is to be performed and embossing the braille string in the designated braille-embossing area.

5 Claims, 14 Drawing Sheets

EMBOSSING CONTROL METHOD, PROGRAM, BRAILLE-EMBOSSING APPARATUS, AND CHARACTER-INFORMATION-PROCESSING APPARATUS

The entire disclosure of Japanese Patent. Application No. 2005-002988, filed Jan. 7, 2005, is expressly incorporated by reference herein.

BACKGROUND

1. Technical Field

The present invention relates to an embossing control method used in a braille-embossing apparatus for making a braille label that can be recognized by visually impaired people, a program, the braille-embossing apparatus, and a character-information-processing apparatus.

2. Related Art

Apparatuses that form braille characters recognizable by visually impaired people and ink characters (which means normal, printed characters as opposed to braille characters) recognizable by sighted people who are not visually impaired on the same medium to make braille labels or braille receipts that can be recognized by both visually impaired people and sighted people are known (refer to, for example, JP-A-2003-182158, FIG. 5).

In such an apparatus, the ink characters and the braille characters are formed in the same area to display both the ink-character information and the braille information in a minimum space. However, some users may wish to arrange the ink-character information and the braille information in the upper and lower direction instead of overlapping them on each other. In addition, users may also wish to decide whether to place the ink-character information above the braille information or vice versa. However, there is no apparatus that can satisfy such requirements in braille-embossing apparatuses that emboss braille characters on a tape-shaped braille embossing medium having a limited width.

SUMMARY

An advantage of the invention is that it provides an embossing control method by which the position of a braille-embossing area along the width of a tape used as a braille embossing medium can be designated, a program, a braille-embossing apparatus, and a character-information-processing apparatus.

According to an aspect of the invention, an embossing control method is used in a braille-embossing apparatus including an embossing head that embosses a braille string on a tape fed along a tape-conveying path, the braille string being embossed in an area biased to one of upper and lower sides of the tape along the width of the tape without changing the upper and lower direction of the braille string. The embossing control method includes the steps of designating the area biased to one of the upper and lower sides of the tape along the width of the tape as a braille-embossing area in which braille embossing is to be performed and embossing the braille string in the designated braille-embossing area.

According to another aspect of the invention, a braille-embossing apparatus includes an embossing head that embosses a braille string on a tape fed along a tape-conveying path, the braille string being embossed in an area biased to one of upper and lower sides of the tape along the width of the tape without changing the upper and lower direction of the braille string. In addition, the braille-embossing apparatus includes a designating device that designates the area biased to one of the upper and lower sides of the tape along the width of the tape as a braille-embossing area in which braille embossing is to be performed and an embossing device that embosses the braille string in the designated braille-embossing area.

According to a further aspect of the invention, a character-information-processing apparatus includes two discontinuous tape conveying paths including an ink-character tape conveying path and a braille tape-conveying path; an ink-character printing device that prints an ink character on a tape inserted into the ink-character tape conveying path; a braille-embossing device that embosses a braille string on the tape inserted into the braille tape-conveying path in an area biased to one of upper and lower sides of the tape along the width of the tape; and an area-designating device that designates an arbitrary area along the width of the tape as an ink-character printing area in which ink-character printing is to be performed and the area biased to one of the upper and lower sides of the tape along the width of the tape as a braille-embossing area in which braille embossing is to be performed. The ink-character printing device and the braille-embossing device perform ink-character printing and braille embossing, respectively, in the areas designated by the area-designating device.

Accordingly, the area biased to one of the upper and lower sides of the tape along the width of the tape, that is, one of the upper and lower areas of the tape can be designated as the braille-embossing area in which braille embossing is to be performed. Therefore, the position of the braille-embossing area along the tape width can be changed in accordance with the user's preferences or needs. In addition, in the above-described character-information-processing apparatus, ink-character printing can also be performed and the positions of the ink-character printing area and the braille-embossing area along the tape width can be designated. "The area biased to one of the upper and lower sides of the tape along the width of the tape" means the upper or lower area defined on the basis of the upper and lower direction of the braille string. In addition, "the upper and lower direction of the braille string" is not defined such that the embossing salients of the embossing points included in each braille character point upward but is defined as the upper and lower direction of the braille character along the width of the tape. The invention may also be applied to a case in which an embossing head that can emboss a plurality of lines of braille characters at the same time is used.

In the above-described embossing control method, the embossing head is preferably disposed biased to one of the opposite sides of the tape-conveying path along the width of the tape-conveying path, the tape being inserted into the tape-conveying path such that the braille-embossing area of the tape faces the embossing head. In addition, preferably, the embossing control method further includes the step of rotating braille data used in braille embossing by 180° after designating the area biased to one of the upper and lower sides of the tape along the width of the tape as the braille-embossing area and before embossing the braille string in the designated braille-embossing area, so that the upper and lower direction of the braille string matches the upper and lower direction of the tape inserted into the tape-conveying path.

In addition, in the above-described character-information-processing apparatus, the braille-embossing unit preferably includes an embossing head disposed biased to one of the opposite sides of the braille tape-conveying path along the width of the braille tape-conveying path, the tape being inserted into the braille tape-conveying path such that the braille-embossing area of the tape faces the embossing head. In addition, the braille-embossing unit preferably rotates braille data used in braille embossing by 180° in accordance with the result of designation performed by the area-designating device so that the upper and lower direction of the braille string matches the upper and lower direction of the tape inserted into the braille tape-conveying path.

When, for example, the embossing head is disposed biased to the lower side of the tape conveying path along the width thereof, braille data is embossed in an upright position (normal embossing is performed) if the lower area of the tape along the width thereof is designated as the braille-embossing area. If the upper area is designated as the braille-embossing area, the tape is inserted upside down so that the braille-embossing area faces the embossing head. Therefore, the braille data is rotated by 180° in the braille embossing process to maintain the upper and lower direction of the braille string. Since the braille data is rotated by 180° in the braille embossing process to maintain the upper and lower direction of the braille string, even when the embossing head is disposed biased to one of the sides of the tape conveying path along the width thereof (that is, even when an embossing head having the same width as the tape width or an embossing head that can move to positions where it faces the upper and lower areas of the tape is not provided), the position of the braille-embossing area along the width of the tape can be designated in accordance with the user's preferences.

In the above-described embossing control method, the tape may be manually inserted into the tape conveying path and information indicating an insertion direction in which the tape is to be inserted into the tape-conveying path may be printed on the tape.

In such a case, since the information indicating the insertion direction is printed on the tape, the user is prevented from inserting the tape from the back by mistake.

In the above-described character-information-processing apparatus, preferably, the tape is manually inserted into the braille tape-conveying path after ink-character printing. In addition, the ink-character printing device preferably prints information indicating an insertion direction in which the tape is to be inserted into the braille tape-conveying path and rotates ink-character data used in ink-character printing by 180° in accordance with the insertion direction and the result of designation performed by the area-designating device so that the upper and lower direction of the braille sting matches the upper and lower direction of the ink-character string.

Accordingly, since the information indicating the insertion direction is printed on the tape, the user is prevented from inserting the tape from the back by mistake. In addition, a label with good appearance in which the upper and lower direction of the ink character matches the upper and lower direction of the braille string can be obtained.

In the above-described embossing control method, information indicating the upper and lower direction of the braille string may be printed on the tape.

In addition, in the above-described character-information-processing apparatus, the ink-character printing device may print information indicating the upper and lower direction of the ink character and the braille string.

Accordingly, since the information indicating the upper and lower direction of the braille string is printed on the tape, the user is prevented from using (adhering) the tape upside down by mistake. Even when an ink character is printed on the tape, there is a possibility that the upper and lower direction thereof cannot be determined (for example, when an arrow or the number 0 is printed). Therefore, when the information indicating the upper and lower direction of the ink character and the braille string is printed, the user can reliably recognize the upper and lower direction along the tape width.

According to a still further aspect of the invention, a program causes a computer to execute each step of the embossing control method.

Thus, a program for executing the embossing control method by which the position of the braille-embossing area along the tape width can be designated is provided.

BRIEF DESCRIPTION OF THE DRAWINGS

The invention will be described with reference to the accompanying drawings, wherein like numbers reference like elements.

DESCRIPTION OF EXEMPLARY EMBODIMENTS

An embossing control method, a program, a braille-embossing apparatus, and a character-information-processing apparatus according to an embodiment of the invention will be described with reference to the accompanying drawings. According to the present embodiment, when a tape is used as a braille embossing medium, the position of a braille-embossing area along the width of the tape can be set biased to either the upper side or the lower side of the tape depending on the user's preferences or needs.

In the following description, a case is considered in which the embossing control method, the program, the braille-embossing apparatus, and the character-information-processing apparatus according to the embodiment of the invention are applied to a label-making apparatus that forms braille characters and ink characters recognizable by sighted people on a single tape to make a braille label recognizable by both visually impaired people and sighted people.

Figure 1:
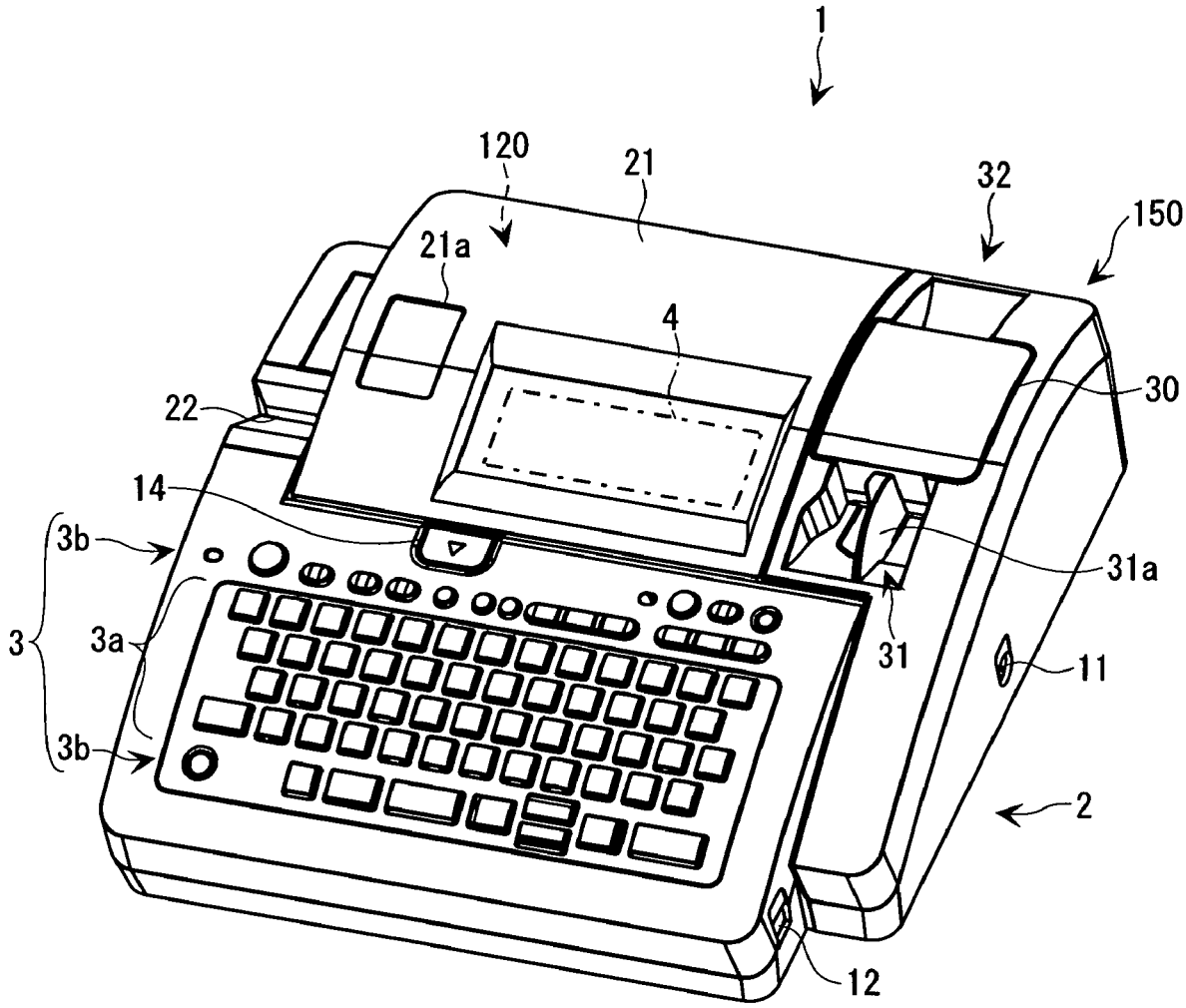
FIG. 1 is a perspective view of a label-making apparatus according to an embodiment of the invention with its lid closed.
Figure 2:
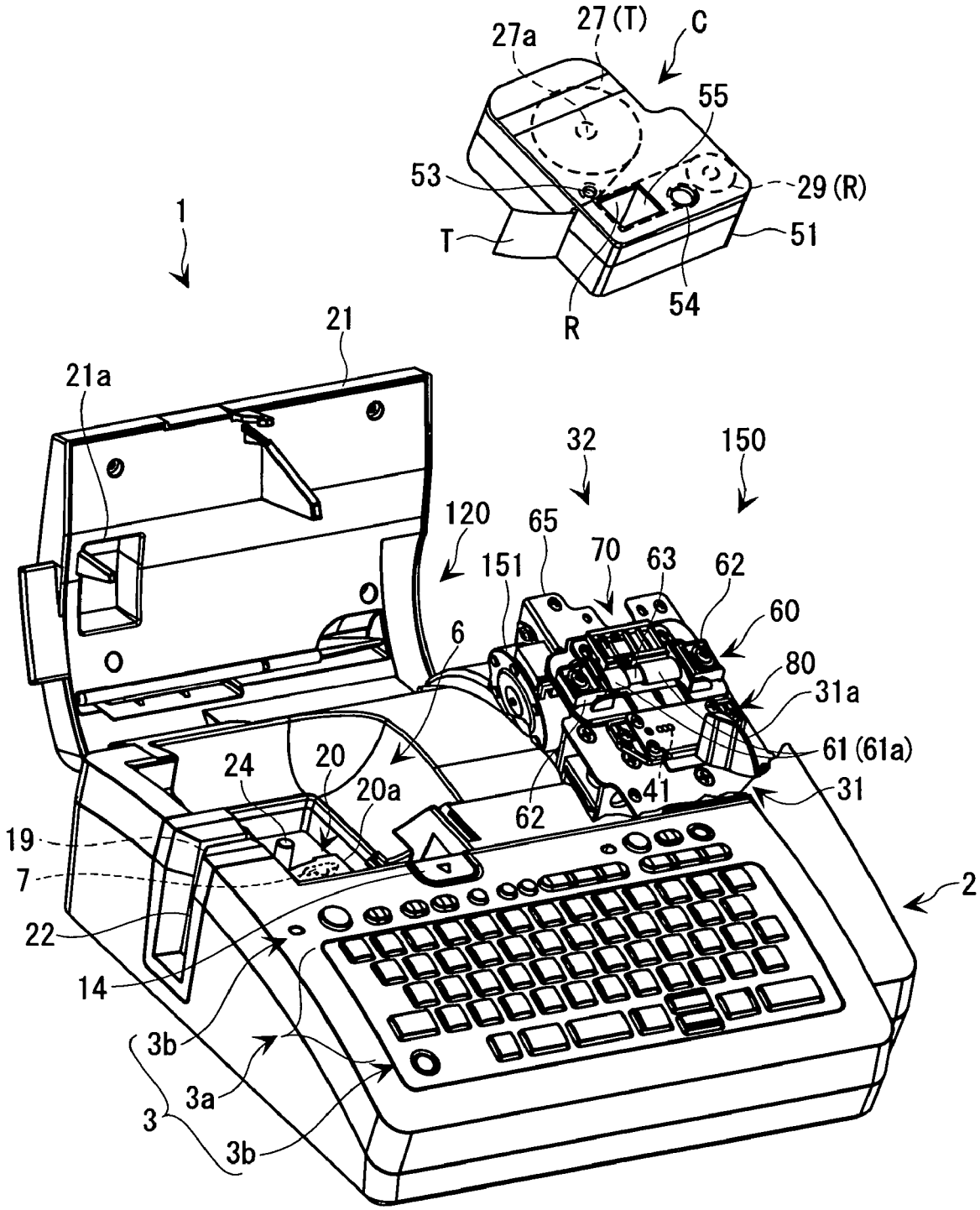
FIG. 2 is a perspective view of the label-making apparatus with its lid opened.

FIG. 1 is a perspective view of a label-making apparatus 1 with its lid closed, and FIG. 2 is a perspective view of the label-making apparatus 1 with its lid opened. In FIG. 2, a part of a housing 2 is shown in a partial cutaway view in order to clearly show a braille-embossing section 150 that performs braille embossing. As shown in FIGS. 1 and 2, the label-making apparatus 1 includes the housing 2 that functions as an outer shell. The housing 2 has a keyboard 3 on the top front surface thereof and an opening/closing lid 21 attached at the top rear surface thereof. An ink-character-printing section 120 that prints ink characters (letters, symbols, etc.) on a tape T fed from a tape cartridge C is disposed behind the opening/closing lid 21. In addition, the braille-embossing section 150 that performs braille embossing when the tape T is inserted from the leading edge thereof is installed in a space on the right of the opening/closing lid 21 (i.e., the right back space in the housing 2).

The opening/closing lid 21 has a rectangular display 4 on the front side, and a cartridge-mounting section 6 (ink-character-printing section 120) for receiving the tape cartridge C is also provided in a left region behind the opening/closing lid 21. The opening/closing lid 21 opens when a lid-opening button 14 is pressed, and the tape cartridge C is detachably attached to the cartridge-mounting section 6 while the opening/closing lid 21 is open. The opening/closing lid 21 has a viewing window 21*a* so that a user can check whether or not the tape cartridge C is mounted without opening the opening/closing lid 21.

The display 4 has a rectangular shape of about 12 cm in the horizontal (X) direction and about 5 cm in the upper and lower (Y) direction and is capable of displaying image data of 192 dots×80 dots. The display 4 is used to display ink-character information input by a user through the keyboard 3 and six-dot braille information. The display 4 is also used to create and edit ink-character data used in ink-character printing and braille data used in braille embossing in accordance with the input information. The display 4 also informs the user of various errors and messages (instructions).

The keyboard 3 including various input keys is provided on the top surface of the housing 2. Character keys 3*a* and function keys 3*b* for designating various operation modes are arranged on the keyboard 3. The character keys 3*a* have a full key pattern based on Japanese Industrial Standards (JIS) key arrangement, and are used to input character information and six-dot braille information. The character information includes information that is input in the form of kana characters (Japanese phonetic characters) or Roman characters to generate ink-character data used in ink-character printing and braille data used in braille embossing. The six-dot braille information includes information input by directly designating embossing/non-embossing dots using number keys corresponding to six embossing points (see 201*a* to 201*f* in FIG. 3A) to generate braille data. Although ink-character printing and braille embossing can also be performed on the basis of the same character information, character information for ink-character printing and character information for braille embossing are individually input in the present embodiment.

The label-making apparatus 1 can make two kinds of labels: ink-character labels L1 (see FIG. 7A) on which only ink characters P are printed and braille labels L2 (see FIG. 7B) on which both the ink characters P are printed and braille characters B are embossed. The function keys 3*b* include mode selection keys (an "ink-character mode" key and a "braille mode" key) for designating whether to make an input for generating the ink-character data or the braille data, a "feed start" key for issuing a command to start feeding the tape T in the braille-embossing section 150, and an "embossing start" key for manually starting the braille-embossing process. In addition, similar to common word processors and the like, the function keys 3*b* also include a "cancel" key for canceling processes, a "cursor" key for moving a cursor, and a "confirmation (Enter)" key for selecting an item on various selection (designation) screens or starting a new line in a text input process.

A power supply port 11 for supplying electric power is formed in the right side of the housing 2 at the central region thereof. In addition, a connection port (interface) 12 for providing connection to an external apparatus (not shown), such as a personal computer, is also formed in the right side of the housing 2 at a front region thereof. Accordingly, ink-character printing and braille embossing can be performed on the basis of character information created by the external apparatus by connecting the external device to the connection port 12. A printed-tape output slot 22 through which the cartridge-mounting section 6 communicates with the outside is formed in the left side of the housing 2. A cutting mechanism 19 (a cutter section 140 shown in FIG. 6) for cutting the tape T output from the ink-character-printing section 120 is disposed so as to face the printed-tape output slot 22. The tape T is cut by the cutting mechanism 19 so that the tape T can be output through the printed-tape output slot 22 after the ink-character-printing process.

A structure around the ink-character-printing section 120 (cartridge-mounting section 6) and the braille-embossing section 150 will be described below. The cartridge-mounting section 6 includes a head unit 20 in which a print head 7 including a thermal head is mounted under a head cover 20*a*, a platen drive shaft (not shown) that faces the print head 7, a take-up drive shaft (not shown) for winding an ink ribbon R, which will be described below, and a positioning boss 24 for a tape reel 27, which will be described below. The platen drive shaft and the take-up drive shaft are rotated by a print feed motor 121 (see FIG. 6) disposed under the cartridge-mounting section 6.

The tape cartridge C includes a cartridge case 51 containing the tape reel 27 around which the tape T having a certain width is wound at the upper central position thereof and a ribbon reel 29 around which the ink ribbon R is wound at a lower right position thereof. The tape T and the ink ribbon R have the same width. A through hole 55 for receiving the head cover 20*a* that covers the head unit 20 is formed in the tape cartridge C at a lower left position with respect to the tape reel 27, and a platen roller 53 that engages with the platen drive shaft to rotate together therewith is disposed at a position where the tape T and the ink ribbon R lie on top of each other. In addition, a ribbon take-up reel 54 is disposed near the ribbon reel 29, and the ink ribbon R unwound from the ribbon reel 29 is pulled around the head cover 20*a* and is wound around the ribbon take-up reel 54.

When the tape cartridge C is mounted to the cartridge-mounting section 6, the head cover 20*a*, the positioning boss 24, and the take-up drive shaft are inserted into the through hole 55, a center hole 27*a* of the tape reel 27, and a center hole of the ribbon take-up reel 54, respectively. The print head 7 is pressed against the platen drive shaft (platen roller) with the tape T and the ink ribbon R disposed therebetween, so that ink-character printing can be performed. The tape T is conveyed to the printed-tape output slot 22 after the ink-character-printing process.

Although not shown in the figure, the tape T includes a recording sheet (made of, for example, polyethylene terephthalate) having an adhesive layer on the back surface thereof and a peel sheet (made of, for example, polyethylene/polypropylene copolymer) adhered to the recording sheet by the adhesive layer. A print surface of the recording sheet is processed such that ink can be reliably transferred thereto in the thermal transfer process. When the tape T obtained by laminating the recording sheet and the peel sheet is "half-cut", as described below, only the recording sheet is cut along the width of the tape so that the recording sheet can be easily separated from the peel sheet.

A plurality of kinds of tapes with different widths, colors, ink colors, materials, etc., are prepared to be used as the tape T, and the cartridge case 51 has a plurality of holes (not shown) indicating the kind of the tape contained therein in the back surface thereof. A plurality of tape-discriminating sensors (microswitches) 171 (see FIG. 6) for detecting the holes formed in the cartridge case 51 are provided in the cartridge-mounting section 6 at positions corresponding to the holes. Accordingly, the kind of the tape can be determined from the result of detection of the tape-discriminating sensors 171.

An assembly for performing braille embossing (the braille-embossing section 150) is installed in the right back space in the housing 2. This assembly is covered with an embossing-section cover 30 at the top. An embossing-tape insertion slot 31 through which the user manually inserts (feeds) the tape T is provided in front of the embossing-section cover 30, and an embossed-tape output slot 32 through which the tape T is output after the braille-embossing process is provided behind the embossing-section cover 30. The embossing-tape insertion slot 31 and the embossed-tape output slot 32 are inclined to form a downward slope along a tape conveying path (feed path) 70. In addition, a manual feed guide 31*a* that is adjustable along the width of the tape is disposed near the embossing-tape insertion slot 31.

The braille-embossing section 150 includes an embossing unit 80 that performs braille embossing using three embossing pins (embossing head). 41 (see FIG. 4B); a tape feed unit 60 that conveys the tape T inserted through the embossing-tape insertion slot 31 to the embossed-tape output slot 32; and the tape conveying path 70 along which the tape T is conveyed. The embossing assembly is formed by attaching the above-mentioned units to a frame that defines the tape conveying path 70 and is integrally mounted to the housing 2. Braille characters B are formed by selectively driving the three embossing pins 41 with the embossing unit 80 while conveying the tape T along the tape conveying path 70 with the tape feed unit 60.

The tape feed unit 60 includes a feed roller pair 61, a support member 62 that supports the feed roller pair 61 on a frame 65, and an embossing feed motor 151 that rotates the feed roller pair 61 in forward and reverse directions. The feed roller pair 61 is a grip roller unit including a drive roller (not shown) and a driven roller 61*a*, and the driven roller 61*a* has an annular groove 63 (see FIG. 5) so as to avoid interference in a region corresponding to the three embossing points 201 (see FIG. 3A), so that the braille characters B can be prevented from being smashed.

Figure 3A:
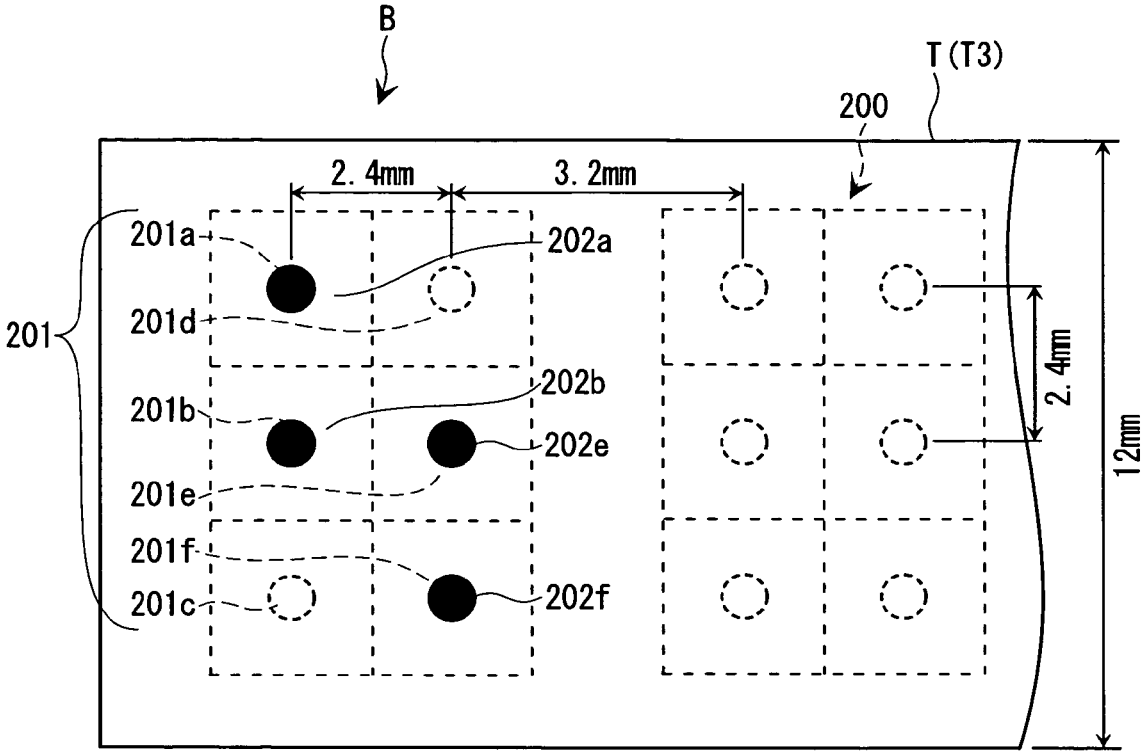
FIGS. 3A and 3B are a diagram illustrating six-dot braille cells and cross sections of embossing salients obtained by a braille embossing process.
Figure 3B:
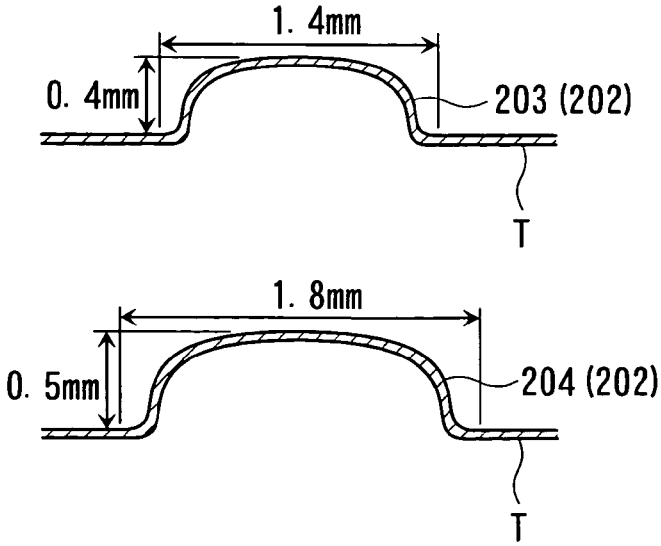

Referring to FIGS. 3A and 3B, a braille character (six-dot braille character) B formed on the tape T (tape T3 with a width of 12 mm) will be described below. FIG. 3A is a diagram showing a braille character (braille data) representing character information "si" (Japanese phonetic character). As shown in FIG. 3A, a single six-dot braille character B is defined by a cell 200 including six dots (embossing points) arranged in two columns and three rows, and this cell 200 represents a single character or an attribute like a dakuten symbol (Japanese voiced sound symbol). Thus, a braille character string includes two or more columns of three vertically arranged dots. In addition to the six-dot braille characters B representing kana characters, numbers, etc., eight-dot braille characters defined by cells including eight dots arranged in two columns and four rows are used to express kanji characters (Japanese ideographic characters). The invention may, of course, also be applied to label-making apparatuses for forming eight-dot braille characters.

In each six-dot braille character B, the cell 200 includes six embossing points 201*a* to 201*f* arranged in two columns and three rows. In FIG. 3A, dots are embossed at four embossing points 201*a*, 201*b*, 201*e*, and 201*f* selected from the six embossing points 201*a* to 201*f*, so that four embossing salients 202*a*, 202*b*, 202*e*, and 202*f* are formed on the tape T. When embossing salients 202 are formed at all of the six embossing points, the embossing salients 202 are arranged with a vertical pitch of about 2.4 mm and a horizontal pitch of about 2.4 mm. In addition, a distance to the next cell (that is, pitch between the cells) is about 3.2 mm.

FIG. 3B shows sectional views of the embossing salients 202. As shown in FIG. 3B, each embossing salient 202 preferably has a cylindrical shape with rounded corners to ensure a good tactile feel. However, the embossing salient 202 may also have a semispherical, a conical, or a quadrangular pyramid shape with rounded corners.

Figure 4A:
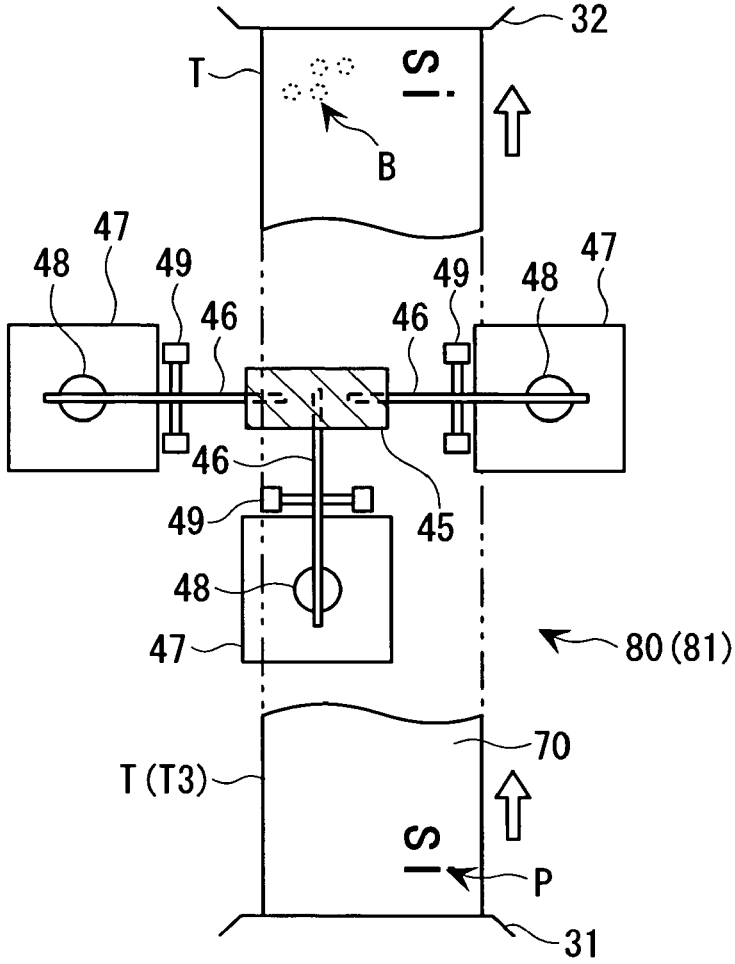
FIGS. 4A and 4B are a plan view of an embossing unit and a sectional view of the embossing unit.
Figure 4B:
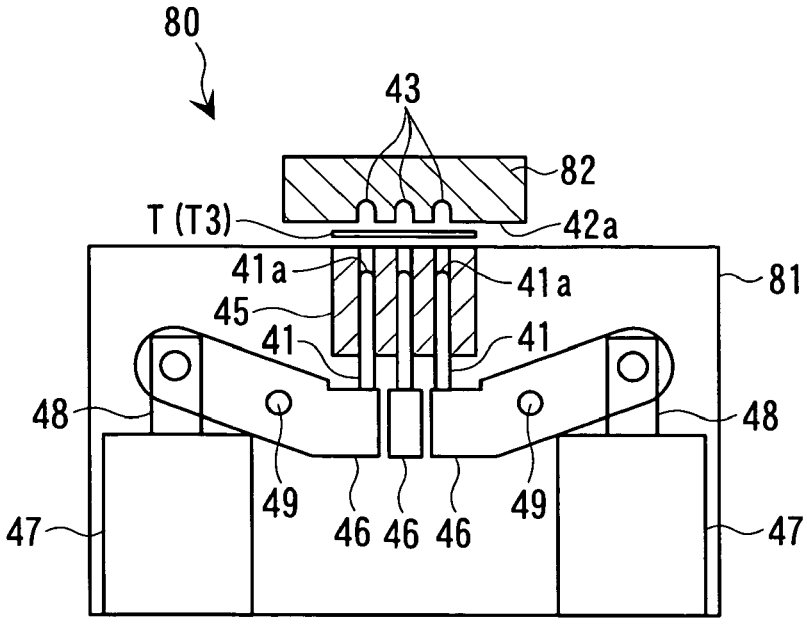

Next, the detailed structure of the embossing unit 80 will be described below with reference to FIGS. 4A and 4B. FIG. 4A is a plan view of the embossing unit 80 seen from the top in FIG. 1, and FIG. 4B is a sectional view of the embossing unit 80. FIG. 4A shows the state in which the tape T with a tape width of 12 mm is manually inserted through the embossing-tape insertion slot 31 after the ink-character printing process, fed to the tape conveying path 70, and conveyed toward the embossed-tape output slot 32.

As shown in FIGS. 4A and 4B, the embossing unit 80 includes an embossing member 81 that has the three embossing pins 41 and an embossed receiving member 82 for receiving the embossing pins 41 that move upward in the embossing process. A shock-resistant spring (not shown) is disposed behind the embossed receiving member 82.

In the embossing member 81, the three embossing pins 41 are arranged along the width of the tape (along the horizontal direction in FIG. 4B) with a pitch of 2.4 mm. The embossing pins 41 correspond to three embossing points 201 arranged vertically in the braille cell including six embossing points 201. The embossing pins 41 are provided with respective solenoids 47 that serve as drive sources and are held perpendicularly to the tape T by an embossing-pin guide 45 that guides the liner motion of the embossing pins 41. Each embossing pin 41 has a head portion 41*a* having a cylindrical shape with rounded corners so that the head portion 41*a* can form an embossing salient 202 having a cylindrical shape with rounded corners.

In addition, each embossing pin 41 is semi-fixed to an arm member 46 at one end thereof, the arm member 46 being connected to a plunger 48 of the corresponding solenoid 47 at the other end and being supported by a supporting member 49 at the center. The plungers 48 of the solenoids 47 are disposed parallel to the embossing pins 41 so that the plungers 48 move linearly in the direction perpendicular to the tape T. When the solenoids 47 cause the plungers 48 to move linearly, the arm members 46 rotate around the support members 49 and the embossing pins 41 linearly move toward the tape T from below in the direction perpendicular to the tape T.

Of the three arm members 46 connected to the respective embossing pins 41, two arm members 46 on both ends extend away from each other along the tape width, and the arm member 46 in the middle extend along the feeding direction of the tape T. The three solenoids 47 connected to the respective arm members 46 are arranged at the vertices of a triangle.

The embossed receiving member 82 has three pin-receiving recesses 43 for receiving the three embossing pins 41 in a surface 42*a* facing the three embossing pins 41. The pin-receiving recesses 43 have a cylindrical shape with rounded corners to correspond to the shape of the head portions of the embossing pins 41. The surface 42*a* that faces the three embossing pins 41 may also be formed as a flat surface made of elastic material, such as synthetic rubber, instead of forming the pin-receiving recesses 43.

The embossing unit 80 forms the embossing salient 202 on the tape T using the embossing pins 41 and the embossed receiving member 82. More specifically, the solenoids 47 are excited in accordance with the braille data generated on the basis of the input information, so that the plungers 48 are pulled and the embossing pins 41 move linearly in the direction perpendicular to the tape T while being guided by the embossing-pin guide 45. Accordingly, the embossing pins 41 encounter the corresponding receiving recesses 43 with the tape T interposed therebetween to form the embossing salient 202 on the tape T.

Next, the tape-feeding operation performed by the braille-embossing section 150 will be described below with reference to FIG. 5. As described above, the braille-embossing section 150 includes the embossing unit 80 that forms the embossing salient 202 on the tape T with the embossing pins 41, the tape conveying path 70 along which the tape T is conveyed, and the tape feed unit 60 that conveys the tape T along the tape conveying path 70. In addition, the braille-embossing section 150 also includes guide members 71 and 72 that guide the conveyance of the tape T along the tape conveying path 70 and a transmissive leading-edge detection sensor 91 that detects the leading edge of the tape T.

The tapes T1, T2, and T3 having a width of 24 mm, 18 mm, and 12 mm, respectively, can be inserted into the embossing-tape insertion slot 31. The tape T1 with the largest width is guided by the upper and lower guide members 71 and 72, and the other tapes T2 and T3 are guided only by the lower guide 71. When, for example, the tape T3 with the smallest width is used, the user manually inserts the tape T3 along the lower guide member 71 until the leading edge thereof reaches the tape feed unit 60 (feed roller pair 61), that is, as deep as the tape can be inserted. The tape feed unit 60 starts feeding the tape T3 when the feed start key on the keyboard 3 is pressed. The detection of the leading edge of the tape T by the leading-edge detection sensor 91 serves as a trigger to start the braille-embossing process in which tape feeding and braille embossing are performed on the basis of the generated braille data. If a front margin between the leading edge of the tape T and the embossing start position (including a non-information area between the leading edge and a half-cut position) is set to be shorter than the distance L1 between the embossing unit 80 (embossing pins 41) and the leading-edge detection sensor 91, the tape T is moved backward by rotating the feed roller pair 61 in reverse. Then, braille embossing and tape feeding in the forward direction are started after the tape T is moved back to an adequate position. However, because of the position of the feed roller pair 61, the front margin must be longer than the distance L2 between the embossing unit 80 and the feed roller pair 61 to perform the above-described process.

Instead of using the detection of the leading edge of the tape T by the leading-edge detection sensor 91 as a trigger, the embossing unit 80 may also start the braille-embossing process when the embossing start key on the keyboard 3 is manually pressed by the user.

Figure 5:
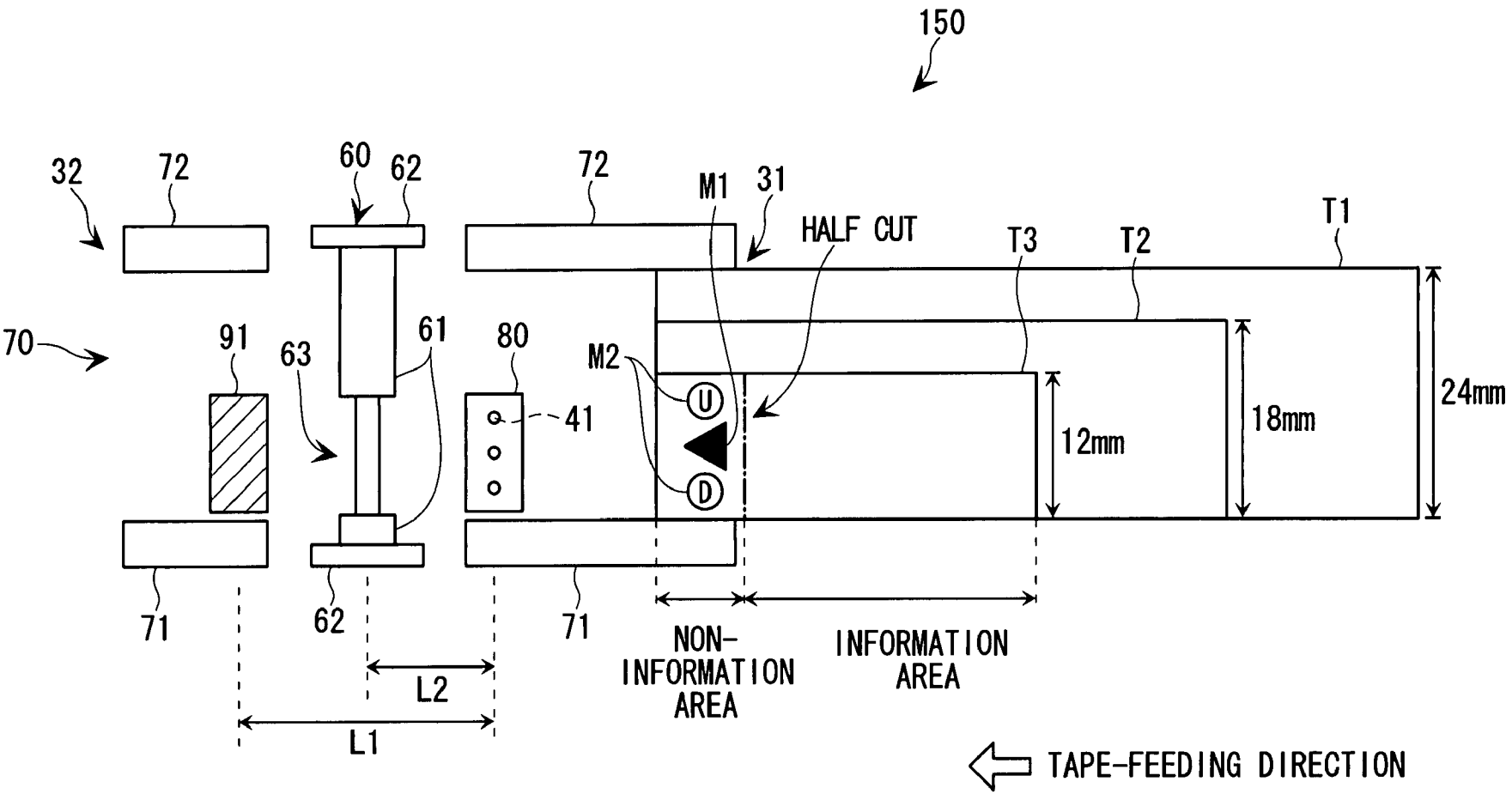
FIG. 5 is a diagram illustrating the manner in which a tape is conveyed through a braille-embossing section.

Referring to FIG. 5, an insertion mark M1 indicating the insertion direction in which the tape T is to be inserted into the embossing-tape insertion slot 31 (direction in which the tape T is to be conveyed along the conveying path 70) and up/down marks M2 indicating the upper and lower direction of the tape T (same as the upper and lower direction of the ink characters P and the braille characters) are printed on the tape T by the ink-character-printing section 120 (see the tape T3). These marks M1 and M2 are printed in a non-information area (area between a half-cut line and the leading edge of the tape T) so that they do not degrade the visibility of an information area (area between the half-cut line and the trailing edge of the tape T). In the example shown in the figure, the up/down marks M2 include a 'U' mark representing "up", and a 'D' mark representing "down". However, instead of printing the up/down marks, a character (ink-character) string, e.g. "insertion direction", may be printed near the insertion mark M1 so that the user can recognize the upper and lower direction of the tape from that of the character string. In addition, the direction of insertion through the embossing-tape insertion slot 31 and the upper and lower direction of the tape T may also be indicated with a single mark. In addition, the insertion mark M1 may also be shown as, e.g. an arrow, and is not limited as long as the insertion direction of the tape T can be indicated.

Next, an operation for embossing a braille character representing a kana character (Japanese phonetic character) "si" (see FIG. 3A) will be described below. The tape T inserted through the embossing-tape insertion slot 31 is conveyed along the tape conveying path 70 until the first three embossing points 201*a*, 201*b*, and 201*c* face the respective embossing pins 41. When the tape T reaches this position, tape feeding is temporarily stopped and embossing is started. In the first column of the braille character representing "si", embossing is performed at the embossing points 201*a* and 201*b*. Therefore, first, one of the three embossing pins 41 that is disposed at the top is driven to form the embossing salient 202*a*. Then, the embossing pin 41 in the middle is driven to form the embossing salient 202*b*. After embossing is performed at the embossing points 201*a* and 201*b* in the first column, the tape T is further conveyed by about 2.4 mm. Then, embossing is performed at the embossing points 201*e* and 201*f* to form embossing salients 202*e* and 202*f*, respectively, on the surface of the tape T with the middle and bottom embossing pins 41. Then, the tape T is conveyed to a position where the next embossing points that are to be embossed by the embossing pins 41 face the embossing pins 41, and braille embossing is performed. If there is no more embossing points to be embossed (if embossing for the last column is finished), the tape T is conveyed by a distance corresponding to the length of a non-embossing area behind the braille-embossing area and is output through the embossed-tape output slot 32.

Figure 6:
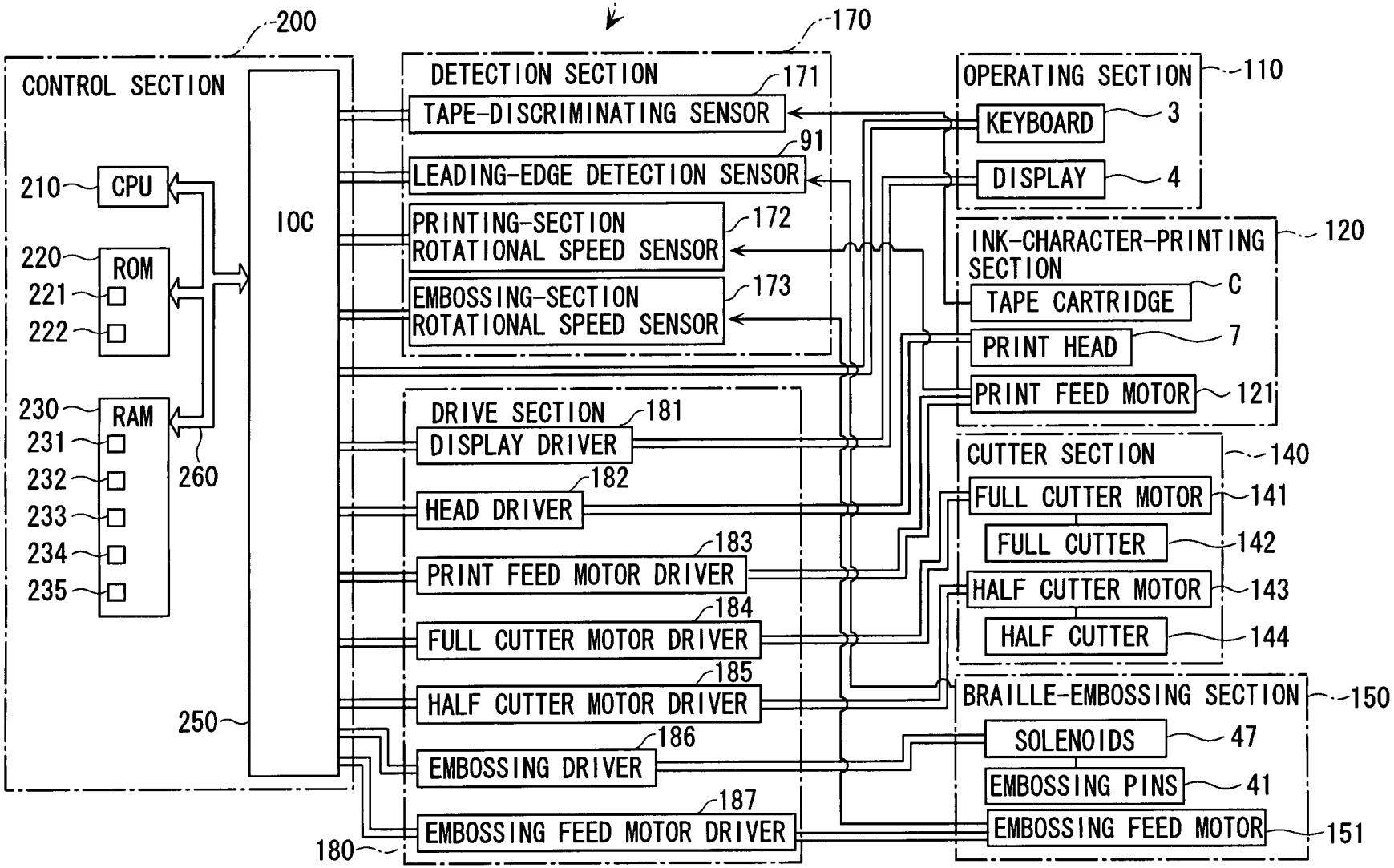
FIG. 6 is a control block diagram of the label-making apparatus.

Next, the control structure of the label-making apparatus 1 will be described with reference to FIG. 6. The label-making apparatus 1 includes an operating section 110, the ink-character-printing section 120, the cutter section 140, the braille-embossing section 150, a detection section 170, a drive section 180, and a control section 200. The operating section 110 includes the keyboard 3 and the display 4 and provides a user interface for inputting character information and displaying various information. The ink-character-printing section 120 includes the tape cartridge C, the print head 7, and the print feed motor (stepping motor) 121 and prints ink characters based on the ink-character data on the tape T while conveying the tape T and the ink ribbon R. The cutter section 140 performs full cut or half cut of the tape T. The braille-embossing section 150 includes the solenoids 47, the embossing pins 41, and the embossing feed motor (stepping motor) 151 and embosses braille characters based on the braille data on the tape T while conveying the tape T. The detection section 170 performs various detections using tape-discriminating sensors 171 that determine the kind of the tape T (tape cartridge C), a leading-edge detection sensor 91 that detects the leading edge of the tape T in the braille-embossing section 150, a printing-section rotational speed sensor 172 that detects the rotational speed of the print feed motor 121, and an embossing-section rotational speed sensor 173 that detects the rotational speed of the embossing feed motor 151. The drive section 180 drives each component with a display driver 181, a head driver 182, a print feed motor driver 183, cutter motor drivers 184 and 185, an embossing driver 186, and an embossing feed motor driver 187, and the control section 200 is connected to each component and controls the overall operation of the label-making apparatus 1.

The cutter section 140 is placed downstream of the ink-character-printing section 120 in the tape-feeding direction, and includes a full cutter 142 and a half cutter 144 disposed adjacent to the cartridge-mounting section 6 so as to face the tape-feeding path (see the cutting mechanism 19 in FIG. 1). The full cutter 142 and the half cutter 144 are driven by the full cutter motor 141 and the half cutter motor 143, respectively. The full cutter 142 cuts both the recording sheet and the peel sheet laminated on each other with a scissors-like member including a fixed cutting edge and a moveable cutting edge. The half cutter 144 cuts only the recording sheet in a press-cutting manner.

The control section 200 includes a central processing unit (CPU) 210, a read only memory (ROM) 220, a random access memory (RAM) 230, and an input/output controller (IOC) 250 which are connected to one another with an internal buss 260. The ROM 220 includes a control program block 221 that stores control programs for causing the CPU 210 to control various processes including the ink-character-printing process and the braille-embossing process and a control data block 222 that stores ink-character font data used in the ink-character printing process, braille font data used in the braille-embossing process, and other various data including print data for printing the insertion mark M1 and the up/down marks M2. A CG-ROM may also be additionally provided instead of storing the character font data in the ROM 220.

The RAM 230 functions as work areas for the control processes and includes a work area block 231 used as a flag, etc.; an ink-character data block 232 that stores the generated ink-character data; a braille data block 233 that stores the generated braille data; a display data block 234 that stores display data to be displayed on the display 4; and a layout block 235 that stores the arrangements (layouts) of ink-character printing areas Ep and braille-embossing areas Eb. The RAM 230 is continuously backed up so that data stored therein can be retained in case of power failure.

The IOC 250 includes logic circuits including gate arrays and custom large-scale integrated (LSI) circuits to complement the function of the CPU 210 and process interface signals obtained from peripheral circuits. The IOC 250 receives input data and control data from the keyboard 3 and transmits the received data to the internal bus 260 directly or after processing them. In addition, the IOC 250 operates in association with the CPU 210 to receive data and control signals output to the internal bus 260 by the CPU 210, and outputs the received data and signals to the drive section 180 directly or after processing them.

The CPU 210 receives various signals and data from each component of the label-making apparatus 1 via the IOC 250, processes various data stored in the RAM 230 on the basis of the received signals and data, and outputs various signals and data to each component of the label-making apparatus 1 via the IOC 250 under the control of the control programs stored in the ROM 220, thereby controlling the ink-character-printing process and the braille-embossing process.

Figure 8A:
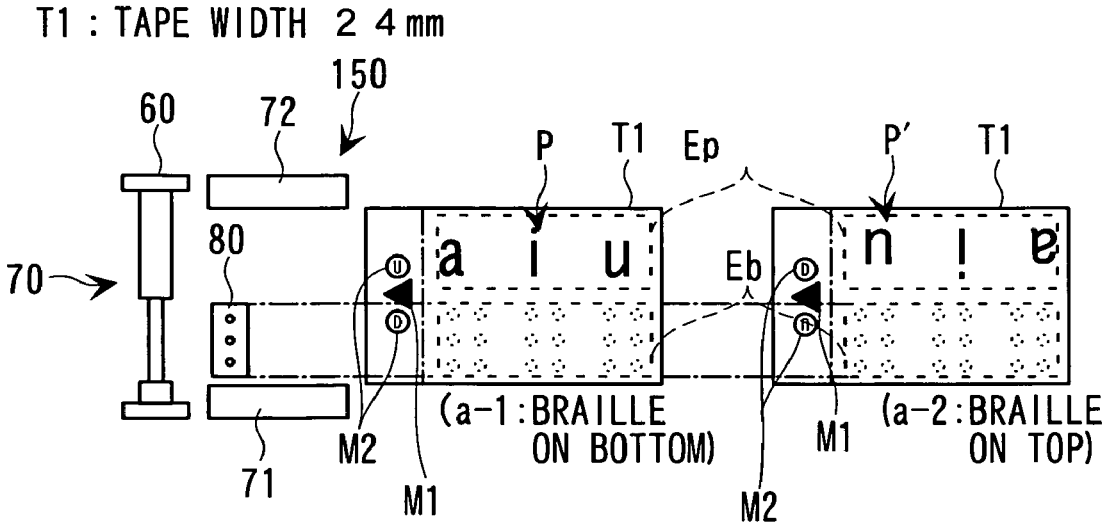
FIGS. 8A to 8C are a diagram showing examples of arrangements of an ink-character printing area and a braille-embossing area on a tape.
Figure 8B:
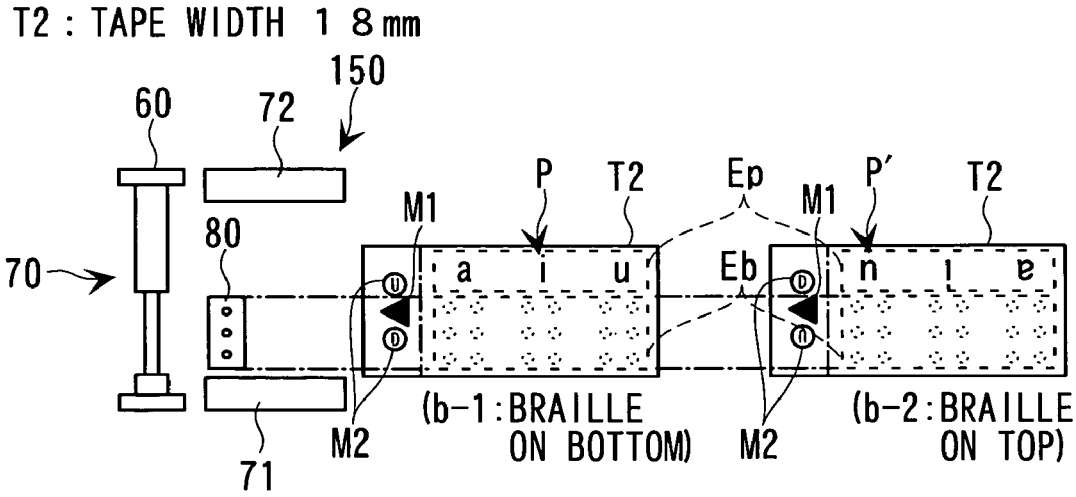
Figure 8C:
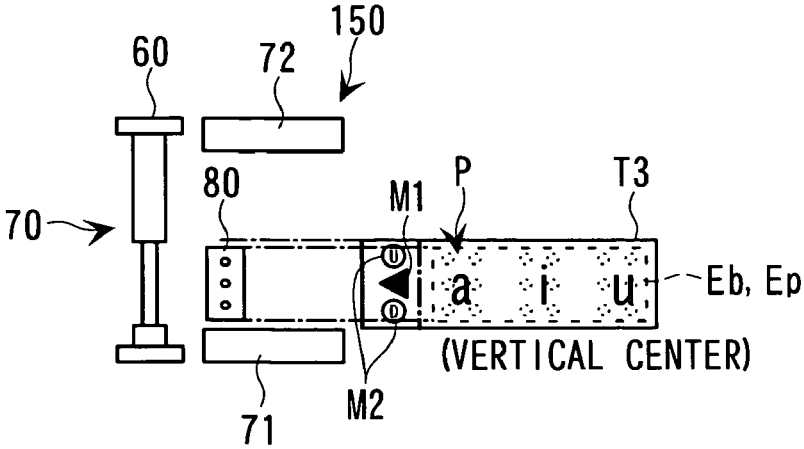

The process of making, for example, a braille label L2 will be described below. When a "power" key is pressed by the user, the CPU 210 performs initialization (e.g., restoration of flags) to reestablish the state at the time when the power was turned off. Then, the kind of the tape T is detected by the tape-discriminating sensors 171 (see FIG. 6). In the present embodiment, the tape width is detected to determine the kind of the tape T (tapes T1, T2, and T3 having widths of 24 mm, 18 mm, and 12 mm, are used as shown in FIGS. 8A to 8C). Then, when character information is input through the keyboard 3, ink-character data is generated on the basis of the input information and is temporarily stored in the ink-character data block 232. In addition, when character information is input in a braille-label mode, braille data is generated on the basis of the input information and is temporarily stored in the braille data block 233. Then, when a "print" key is pressed and a command to make a braille label (print command) is issued, the CPU 210 starts driving the print feed motor 121 and drives the print head 7 in accordance with the detection result obtained by the printing-section rotational speed sensor 172. Accordingly, the insertion mark M1 and the up/down marks M2 are printed (based on the data stored in the control data block 222 in advance), the tape T is half-cut by the half cutter 144, and ink-character printing based on the ink-character data stored in the ink-character data block 232 is performed. Then, the tape T is fed by a predetermined length corresponding to the ink-character data (including back margin data if the length of the back margin can be set when the character information is input), is cut at the trailing end thereof by the full cutter 142, and is output through the printed-tape output slot 22.

After the ink-character-printing process, the CPU 210 displays a message prompting the user to insert the tape T on the display 4. Then, when the user manually inserts the tape T cut into a strip shape into the embossing-tape insertion slot 31, the embossing unit 80 and the tape feed unit 60 are driven so as to emboss the braille characters on the basis of the braille data stored in the braille data block 233, as described above. After the braille-embossing process, the embossing feed motor 151 is driven to convey the tape T by a predetermined distance based on the braille data (including back margin data if the length of the back margin can be set when the character information or the six-dot braille information is input), so that the tape T is output from the embossed-tape output slot 32. When the braille label L2 is made, the ink-character data and/or the braille data are inverted as necessary (see FIG. 9). This will be detailed in more detail below.

Figure 7A:
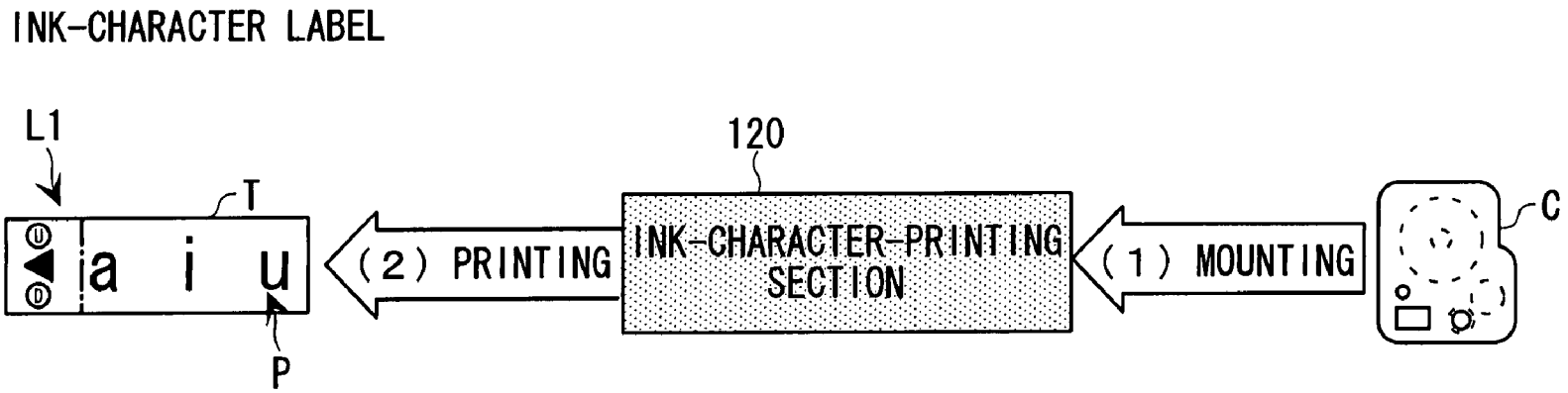
FIGS. 7A and 7B are a diagram showing a basic procedure for making an ink-character label and a basic procedure for making a braille label.

Next, basic procedures for making the ink-character label L1 or the braille label L2 will be described below with reference to FIGS. 7A and 7B. As shown in FIG. 7A, when the ink-character label L1 is made, the tape cartridge C is mounted (1), and then the ink characters P are printed (2) on the tape T fed from the tape cartridge C to the ink-character-printing section 120 on the basis of the input character information. Then, the printed tape T (ink-character label L1) is output. The ink-character label L1 thus obtained is half-cut at a position near the leading edge, but the insertion mark M1 and the up/down marks M2 (see FIG. 5) may not be printed. When the ink-character label L1 is made, a unit for designating whether or not to perform the half-cut may also be provided.

Figure 7B:
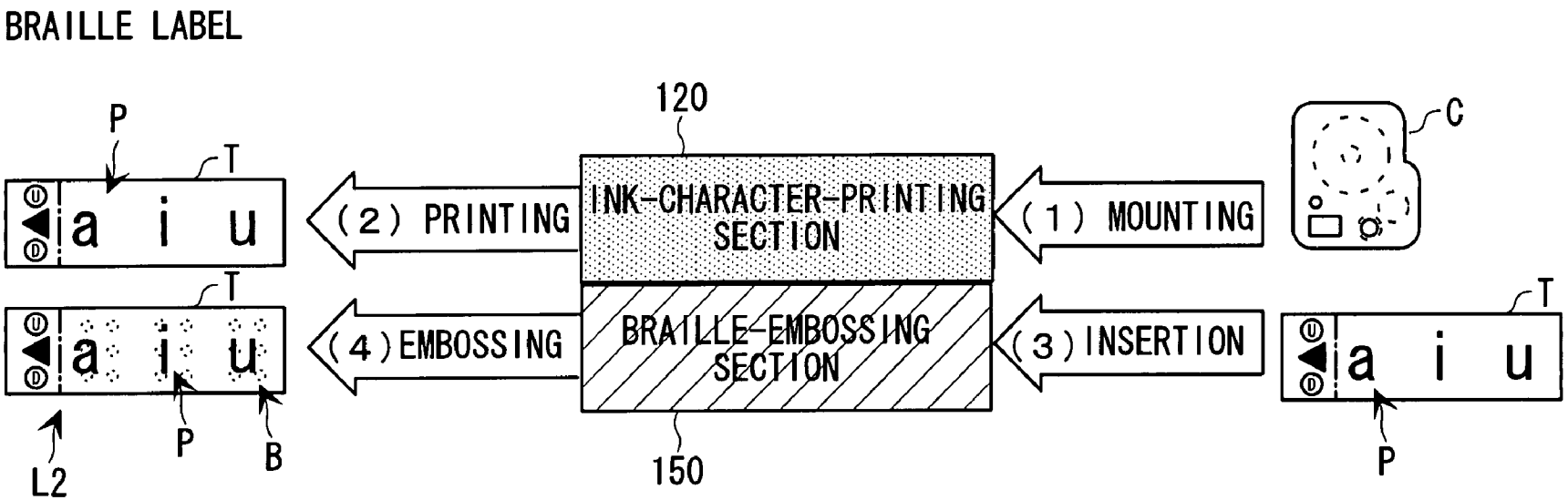

As shown in FIG. 7B, when the braille label L2 is made, the tape cartridge C is mounted (1), the ink characters P are printed (2) on the tape T fed from the tape cartridge C to the ink-character-printing section 120, and then the printed tape T is output. In this case, the ink-character-printing section 120 prints the insertion mark M1 and the up/down marks M2 (see FIG. 5) in the non-information area. Then, the printed tape T is manually inserted (3) in the direction indicated by the insertion mark M1, and is conveyed to the braille-embossing section 150, which embosses the braille characters B (4). The braille label L2 thus obtained has the ink characters P printed and the braille characters B embossed thereon, and can be adhered to a desired object in the upper and lower direction indicated by the up/down marks M2.

In this example, the braille label L2 is formed of the tape T3 having a width of 12 mm. Therefore, the ink characters P and the braille characters B are overlapped with each other. However, when the tape T1 with a width of 24 mm or the tape T2 with a width of 18 mm is used, the upper and lower positions, that is, positions along the tape width, of the ink-character printing area Ep and the braille-embossing area Eb can be set depending on the user's preferences or needs.

Figure 9:
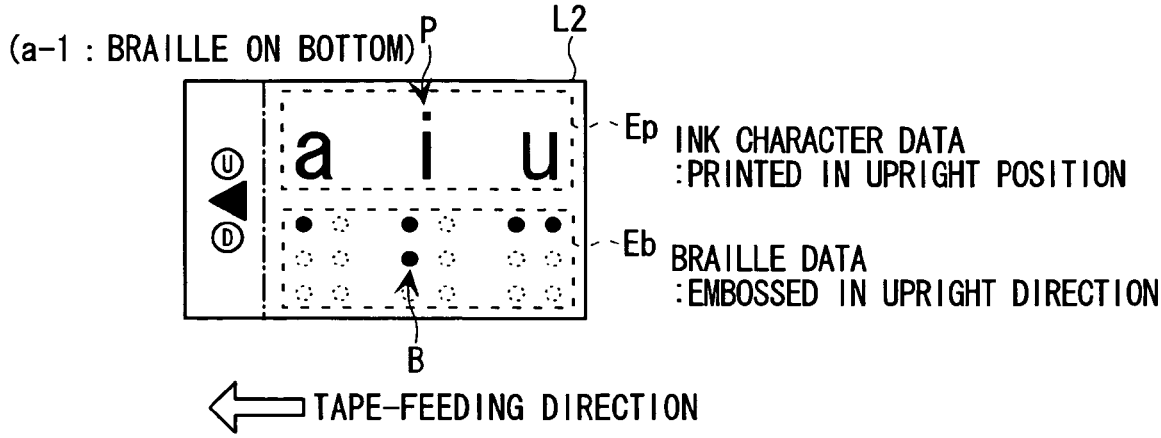
FIG. 9 is a diagram showing printing/embossing directions of ink-character data and braille data.
Figure 9:
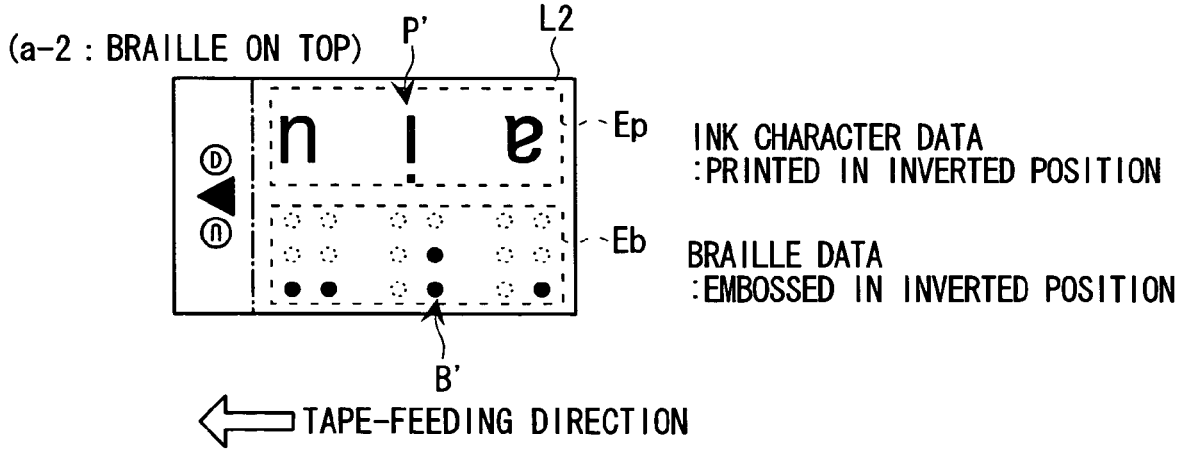

The arrangement of the ink-character printing area Ep and the braille-embossing area Eb along the tape width and an inversion process of the ink-character data and the braille data will be described with reference to FIGS. 8A to 8C and FIG. 9. FIG. 8A to 8C respectively show the tapes T1, T2, and T3 after ink-character printing that are not yet inserted into the braille-embossing section 150. FIG. 9 shows the tape T1 after braille embossing (braille label L2).

First, the arrangements that can be designated will be described below for each tape width. Referring to FIG. 8A, when the tape discriminating sensors 171 (see FIG. 6) detect that the tape width is 24 mm (tape T1), a layout (a-1) in which the ink-character printing area Ep is above the braille-embossing area Eb and a layout (a-2) in which the ink-character printing area Ep is below the braille-embossing area Eb can be designated. In addition, an "overlapping arrangement" in which the ink-character printing area Ep and the braille-embossing area Eb overlap with each other may also be designated (see D09 in FIG. 12). In this case, a data inversion process similar to that for the layout (a-1) is performed, and explanations thereof are thus omitted. The upper and lower direction of the tape T is defined by the direction of the ink characters P and braille characters and the up/down marks M2.

Referring to FIG. 8B, when it is detected that the tape width is 18 mm (tape T2), a layout (b-1) in which the ink-character printing area Ep is above the braille-embossing area Eb and a layout (b-2) in which the ink-character printing area Ep is below the braille-embossing area Eb can be designated. When "upper and lower position", which will be described below, is selected (see D10 in FIG. 12), the size of the printing arrangement section Ep along the tape width is reduced in accordance with the tape width. More specifically, since the size of a single cell 200 of the braille character B along the tape width is fixed, when the tape width is 18 mm, the braille-embossing area Eb is set to an area adjacent to one of the sides perpendicular to the width of the tape (that is, one of the upper and lower sides) and the ink-character printing area Ep is set to the remaining region.

Referring to FIG. 8C, when it is detected that the tape width is 12 mm (tape T3), only the layout in which the ink-character printing area Ep and the braille-embossing area Eb overlap with each other can be selected. Therefore, the ink-character printing area Ep and the braille-embossing area Eb are vertically centered. More specifically, since the tape width of 12 mm (tape T3) is a minimum width that allows the braille cells 200 to be embossed (see FIG. 3A), the user cannot select other layouts.

Next, the inversion process of the ink-character data and the braille data will be described below. When, for example, the tape T1 is used and the layout (a-1) in which the braille-embossing area Eb is on the bottom is designated as shown in FIG. 8A and FIG. 9 (when "braille on bottom" is selected), the ink-character data stored in the ink-character data block 232 and the braille data stored in the braille data block 233 are read out and printed in the upright position (printing and embossing are started from the front ends of the ink-character data and the braille data).

As described above, the braille data includes data generated for embossing the braille characters B on the basis of input character information (kana characters "a-i-u" in this case), front margin data, and back margin data. Therefore, to print the braille data in the upright position means to process the front margin data, data corresponding to the three embossing points 201*a*, 201*b*, and 201*c* (see FIG. 3A) on the left column of the first character ("a" in this case), data corresponding to the three embossing points 201*d*, 201*e*, and 201*f* on the right column of the first character ("a" in this case), data corresponding to the three embossing points 201*a*, 201*b*, and 201*c* on the left column of the second character ("i" in this case), . . . , and the back margin data in that order. It is to be noted that, in FIGS. 7A and 7B, alphabets "a", "i", "u" are transliteration of Japanese hiragana but that the braille characters given therein are those of hiragana, not of alphabets. The same applies to other figures of similar nature such as FIGS. 8A to 8C, 9 to 14, etc. where characters which are said to be written in hiragana are actually represented in alphabets. This is partly to avoid the usage of characters other than alphabets. In such cases, the braille characters correspond to hiragana and katakana whichever the case may be, and do not correspond to alphabets.

When, for example, the layout (a-2) in which the braille-embossing area Eb is on the top is designated as shown in FIG. 8A and FIG. 9 (when "braille on top" is selected), the ink-character data and the braille data are printed and embossed in the inverted positions in which they are rotated by 180° (inverted ink-characters P' and inverted braille characters B' are printed and embossed, respectively). When the embossing unit 80 is disposed along the bottom side of the tape conveying path 70 and the braille characters are to be embossed in the upper area of the tape T, the tape T is inserted from the back edge thereof (the right edge when the upper and lower direction of the tape T is defined by that of the ink characters P and the braille characters) so that the braille-embossing area Eb faces the embossing unit 80. In this case, it is necessary to rotate the braille data by 180° so that the upper and lower direction of the braille characters matches that of the tape T fed to the braille-embossing section 150. Accordingly, the braille data stored in the braille data block 233 is inverted (read out from the back end thereof) in the braille-embossing process. To emboss the braille data in the inverted position in which it is rotated by 180° means to process the back margin data, data obtained by rotating the data corresponding to the three embossing points 201*d*, 201*e*, and 201*f* (see FIG. 3A) on the right column of the last character ("u" in this case) by 180°, data obtained by rotating the data corresponding to the three embossing points 201*a*, 201*b*, and 201*c* on the left column of the last character ("u" in this case) by 180°, data obtained by rotating the data corresponding to the three embossing points 201*d*, 201*e*, and 201*f* on the right column of the second character from the last ("i" in this case) by 180°, . . . , and the front margin data in that order.

When the layout (a-2) in which the ink-character printing area Ep is on the bottom is designated (when "braille on top" is selected), the ink-character data stored in the ink-character data block 232 is also inverted (read from the back end) in the ink-character printing process so that the upper and lower direction of the ink characters P matches that of the braille characters.

Also when the tape T2 is used, the ink-character data and the braille data are printed and embossed, respectively, in the upright position if "braille on bottom" is selected (layout (b-1) in FIG. 8B), and are printed and embossed in the inverted positions in which they are rotated by 180° (the inverted ink characters P' and the inverted braille characters B' are printed and embossed, respectively) if "braille on top" is selected (layout (b-2) in FIG. 8B). When the tape T3 is used, the ink-character data and the braille data are always printed and embossed, respectively, in the upright position since they cannot be arranged vertically.

Next, the detailed procedure for making the braille label L2 will be described below with reference to FIGS. 10 to 13 that illustrate the manner in which the screen on the display 4 changes. In the following description, a case is considered in which the tape T1 with a width of 24 mm is used to make a braille label L2 on which ink characters P are printed in the upper area and braille characters B are embossed in the lower area along the tape width (that is, the label L2 with the layout (a-1) shown in FIG. 9).

Figure 10:
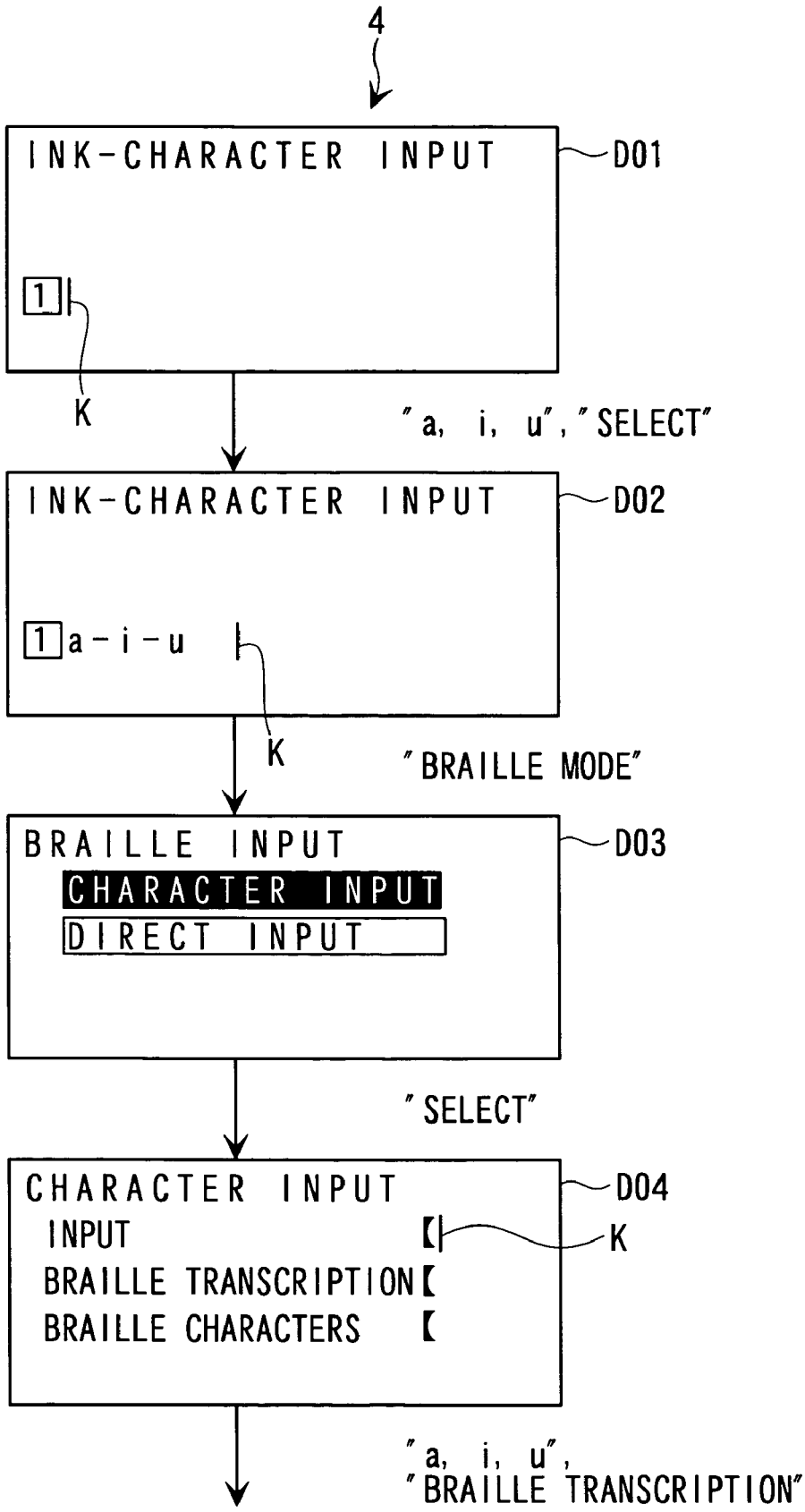
FIG. 10 is a diagram illustrating screens displayed in an operation of making a braille label.
Figure 11:
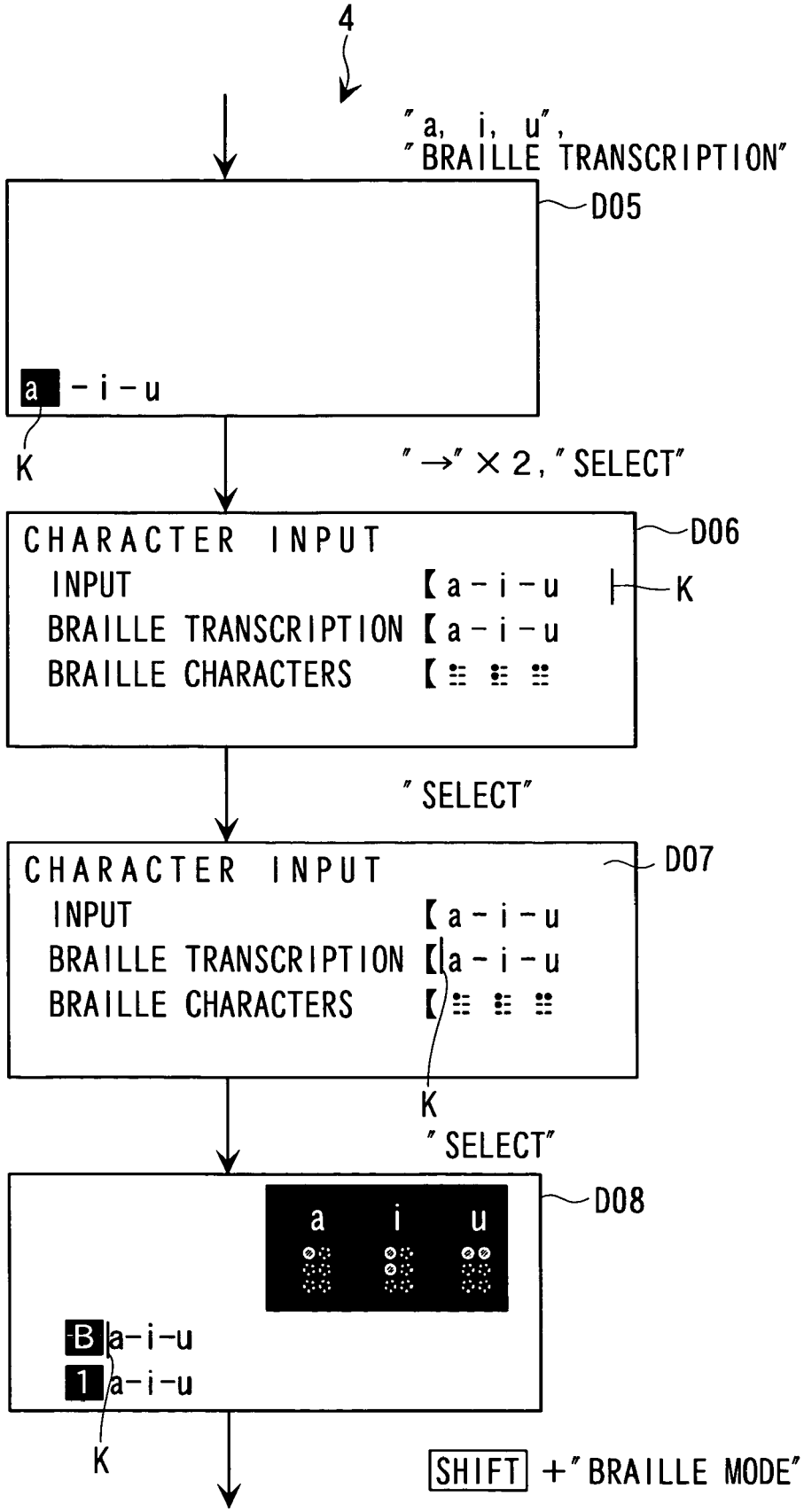
FIG. 11 is a diagram illustrating screens displayed after those shown in FIG. 10.

As shown in FIG. 10, when the user turns on the power of the label-making apparatus 1, an ink-character input screen (text editing screen) D01 is displayed. This screen shows a line-head mark (the number 1 surrounded by a rectangle) that shows that a character can be input in the first line and a cursor K showing the input position. In this state, when the user inputs the character information ("a-i-u") to generate the ink-character data and presses the "select" key, the ink-character input is confirmed (D02). When the ink characters are input, similar to common word processors and the like, various character-information processes, such as kanji conversion and setting of formats and fonts, can be performed. However, explanations of these processes are omitted.

Next, when the user presses the "braille mode" key, the screen changes to a braille input screen D03. In this screen, "character input" for inputting character information or "direct input" for inputting six-dot braille information can be designated. As a default, the "character input" is highlight. When the "select" key is pressed in this state, the screen changes to a character input screen (for braille) D04. The character input screen D04 has an "input" field for inputting and editing a normal character string, a "braille transcription" field for inputting and editing a braille transcription character string, and a "braille character" field for displaying an image of braille characters B corresponding to the braille transcription character string. In the initial state, the cursor K that prompts the user to input the first character in the "input" field is displayed.

When the character information "a-i-u" is input and the "braille transcription" key is pressed, the screen changes to a phrase-information setting screen D05 (see FIG. 11) for setting phrase information required for braille transcription. The phrase-information setting screen (D05) is used to set breakpoints between phrases in the kana character string so that accurate braille transcription can be performed. For example, a character string "kyo-u-ha-i-sya-ni-i-ku" has different meanings depending on whether it is divided into "kyo-u-ha (which means 'today')" and "i-sya-ni-i-ku (which means 'I will go see a doctor')", or into "kyo-u (which means 'today')" and "ha-i-sya-ni-i-ku (which means 'I will go see a dentist')". In the present embodiment, the character string "a-i-u" that does not have any meaning is used as an example to facilitate understanding. Therefore, the phrase information is set such that the character string "a-i-u" is a single phrase. More specifically, the user presses the "→" key twice from the state in which "a" is highlighted so that "a-i-u" is entirely highlighted, and then presses the "select" key. Accordingly, phrase information representing that "a-i-u" is a single phrase is set. After the phrase information is set in the phrase-information setting screen D05, the screen changes to a screen D06 for confirming and editing the phrase information.

In this screen D06, the cursor is placed after "u" to prompt the user to input the next character that follows the normal character string "a-i-u" in the "input" field. In addition, a braille transcription character string "a-i-u" is shown in the "braille transcription" field, and a braille image corresponding to the braille transcription character string is shown in the "braille character" field. When breakpoints between phrases are set in the phrase-information setting screen D05 (for example, when the "select" key is pressed for each of the characters to divide "a-i-u" into three phrases "a", "i", and "u"), spaces are input at positions between the phrases in the "braille transcription" field.

In this state (D06), when the character input is confirmed (when the "select" key is pressed), the cursor moves to the "braille transcription" field and the black star signs are displayed to indicate that the contents of the "input" field are the same as those of the "braille transcription" field (see screen D07). In this screen D07, the cursor K can be moved between the "input" field and the "braille transcription" field or in a single line to check the contents of each field. In addition, in this screen D07, the normal character string in the "input" field and the braille transcription character string in the "braille transcription" field can be edited. If the "braille transcription" key is pressed after editing, the screen changes to the phrase-information setting screen (D05).

When the user presses the "select" key after confirming the contents of the screen D07, the screen changes to a character input screen (text editing screen) D08 including a reduced preview in an upper section thereof. The preview shows an image of a label obtained if the "print" key is pressed in this state. In addition, in a lower section of the screen D08, the braille transcription character string "a-i-u" is shown next to a braille transcription mark ("B" surrounded by a rectangle), and the normal character string "a-i-u" is shown next to the line-head mark. The braille transcription character string and the normal character string can also be edited in this screen. When the "braille transcription" key is pressed after editing, the screen changes to the phrase-information setting screen (D05). This screen also serves as a text editing screen, so that the character information can be input and the format can be set.

Figure 12:
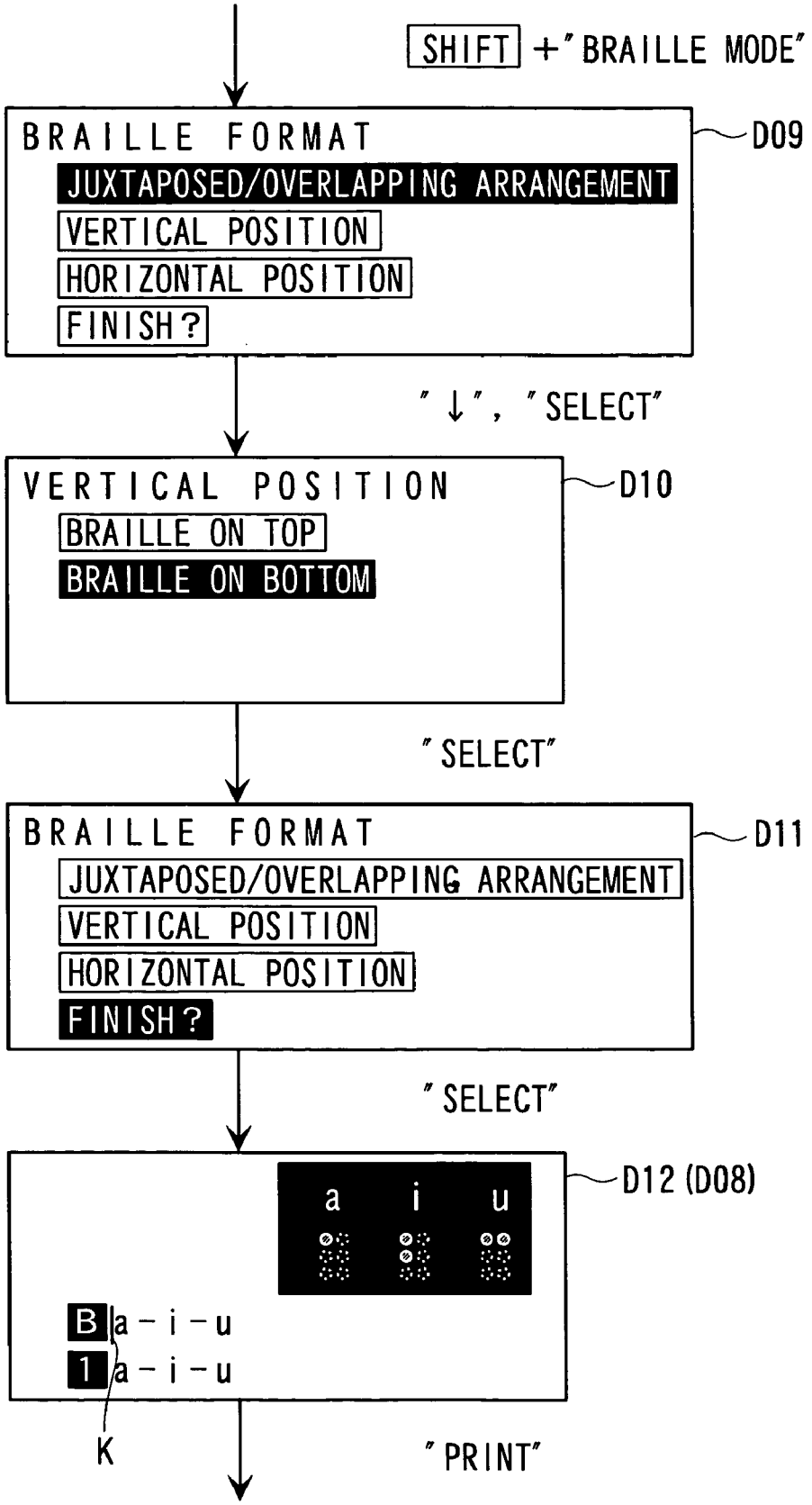
FIG. 12 is a diagram illustrating screens displayed after those shown in FIGS. 10 and 11.

When the user presses the "Shift" key and the "braille mode" key at the same time to set the braille format, the screen changes to a braille-format-setting screen D09 (see FIG. 12). In this screen, "juxtaposed/overlapping arrangement", "upper and lower position", "horizontal position", or "finish?" can be selected, and "juxtaposed/overlapping arrangement" is highlighted as a default. When "juxtaposed/overlapping arrangement" is selected, "juxtaposed arrangement" in which the ink-character printing area Ep and the braille-embossing area Eb are arranged vertically or "overlapping arrangement" in which the ink-character printing area Ep and the braille-embossing area Eb are overlapped with each other can be selected in a lower hierarchy. When "upper and lower position" is selected, whether to place the braille-embossing area Eb in the upper area or the lower area of the tape T can be selected in a lower hierarchy. The printing/embossing result obtained when the "juxtaposed arrangement" is selected after selecting the "juxtaposed/overlapping arrangement" is the same as that obtained when "braille on bottom" is selected after selecting the "upper and lower position". In addition, when the "horizontal position" is selected, the position for arranging the braille-embossing area Eb in the tape T can be selected from right, left, and center in a lower hierarchy.

When "upper and lower position" is designated by pressing the "↓" key and the "select" key, "braille on top" and "braille on bottom" are displayed (D10) so that whether to arrange the braille-embossing area Eb in the upper area or the lower area of the tape T can be determined. In FIG. 12, "braille on bottom" is highlighted as a default. When the "select" key is pressed in this state, "braille on bottom" is determined as the braille format. Then, the screen changes to a braille-format-setting screen D11 where "finish?" is highlighted. When the "select" key is pressed in this state, the braille-format-setting process is finished and the screen changes to a character input screen D12 (identical to D08).

Figure 13:
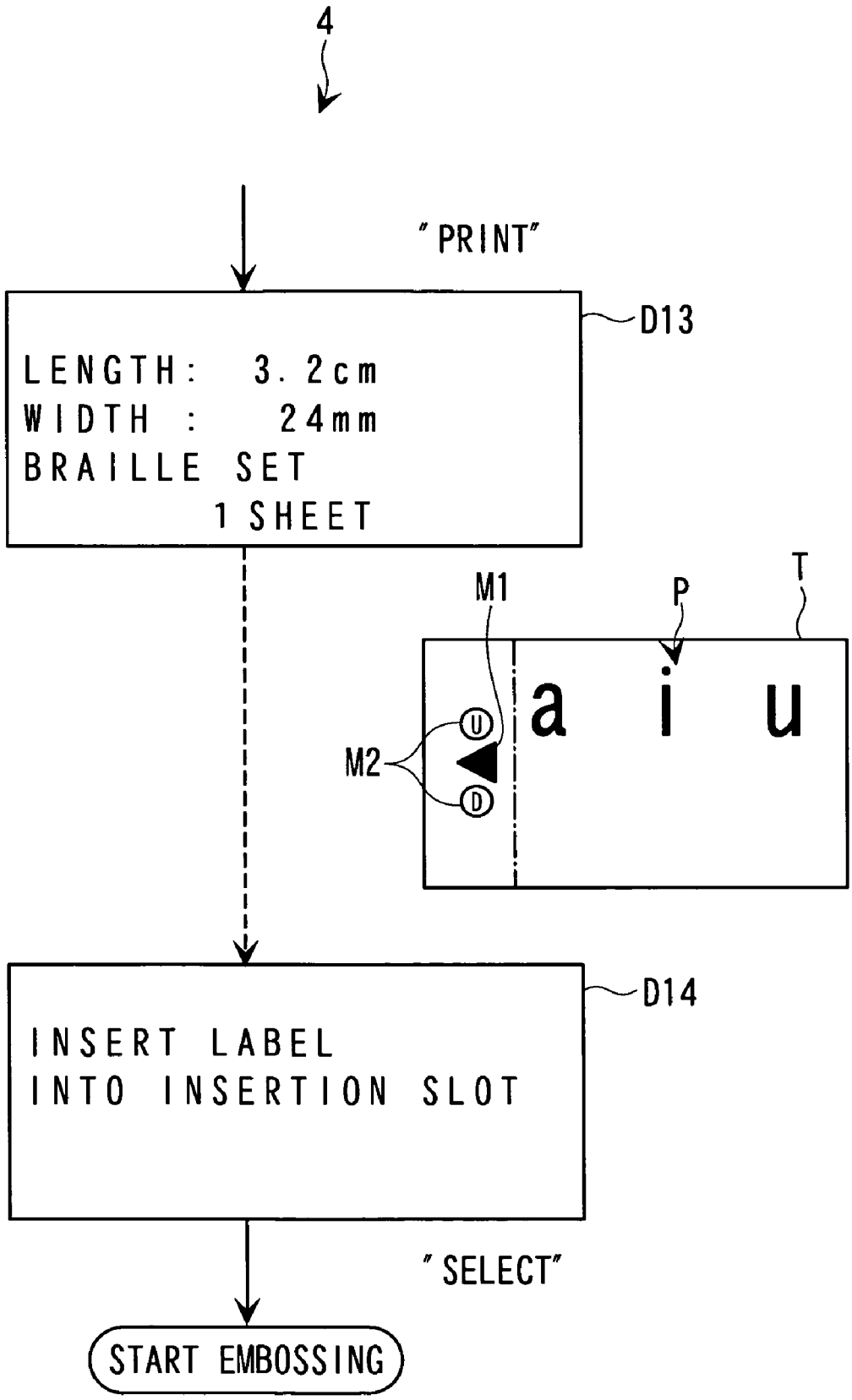
FIG. 13 is a diagram illustrating screens displayed after those shown in FIGS. 10, 11, and 12.

Then, when the "print" key is pressed in this state, the display 4 shows the length and width of the braille label L2 being made, whether or not the braille characters B are set, and the number of labels being printed (D13 in FIG. 13). In the printing process started when the "print" key is pressed, printing of the insertion mark M1 and the up/down marks M2, half-cutting by the half cutter 144, printing of the ink-character information "a-i-u" based on the input information, and full-cutting by the full cutter 142 are performed in synchronization with tape feeding. Then, after these processes, the tape T shown in FIG. 13 obtained by the ink-character printing process is output. Since "braille on bottom" is set in this case, the ink characters "a-i-u" printed in the upright position are arranged in the upper area of the tape T.

The distance between the print start position (the front end of the insertion mark M1 in the example shown in FIG. 13) and the leading edge of the tape along the length thereof is preferably longer than the distance between the print head 7 and the cutting position (position of the full cutter 142). In such a case, it is not necessary to reversely rotate the feed motor to move the tape T backward before starting the printing process.

When the ink-character-printing section 120 finishes the process, the display 4 shows a message "insert label into insertion slot" to inform the user that braille embossing is to be started (D14). Then, when the user inserts the tape T into the embossing-tape insertion slot 31 and presses the "select" key, the braille-embossing process is started on the basis of the character information "a-i-u". Since "braille on bottom" is set, the braille data is embossed in the upright position.

The braille label L2 made by the above-described procedure is shown in FIG. 9 (a-1). More specifically, when "braille on bottom" is set, the ink-character data and the braille data are printed and embossed, respectively, in the upright position. In comparison, when "braille on top" is set in the screen D10 shown in FIG. 12, a braille label shown in FIG. 9 (a-2) is made. More specifically, the ink-character data and the braille data are printed and embossed, respectively, in the inverted position in which they are rotated by 180°. When "overlapping arrangement" is set in the screen D09 shown in FIG. 12, the ink-character data and the braille data are printed and embossed, respectively, in the upright position, as described above.

As described above, according to the embodiment of the invention, the directions in which the ink-character data and the braille data are printed and embossed, respectively, are switched depending on the position of the braille-embossing area Eb. Accordingly, the position of the braille-embossing area Eb along the width of the tape T can be designated depending on the user's preferences without moving the embossing unit 80 along the width of the tape conveying path 70.

In addition, after the ink-character-printing process, the tape T has the insertion mark M1 printed thereon. Therefore, when the user manually inserts the tape T toward the braille-embossing section 150, the tape T can be prevented from being inserted from the back by mistake. In addition, even when the upper and lower (back and forth) direction of the tape T cannot be determined from the result of ink-character printing (for example, when an arrow or the number 0 is printed), the upper and lower (back and forth) direction can be recognized since the up/down marks M2 are printed.

Figure 14:
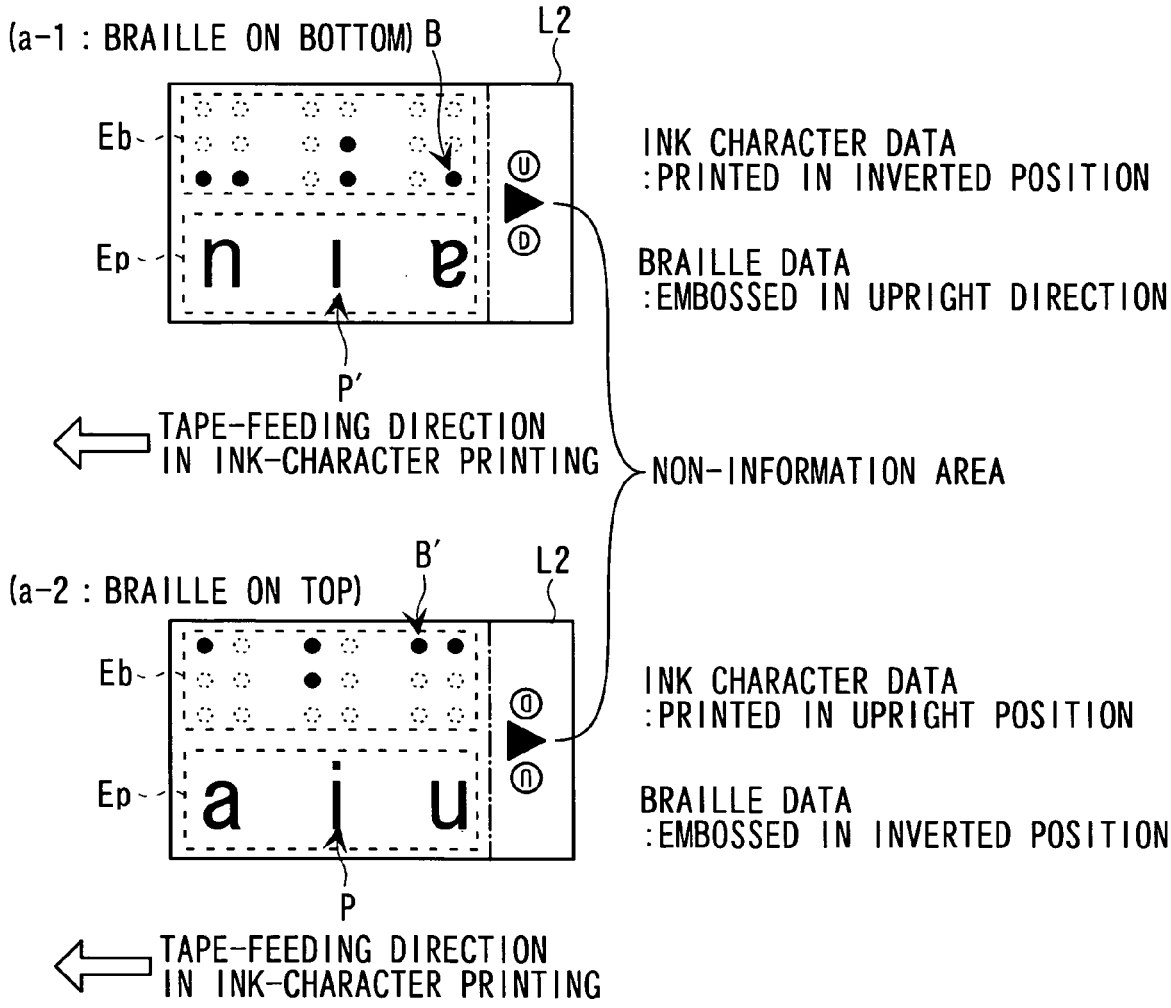
FIG. 14 is a diagram illustrating another example of a method for printing ink-character data and embossing braille data.

In the above-described example, the tape T is half-cut at a position near the leading edge thereof and the insertion mark M1 and the up/down marks M2 are printed in a non-information area defined by the half-cut line (see FIG. 9). However, as shown in FIG. 14, the tape T may also be half-cut at a position near the trailing edge thereof (an upstream position in the tape-feeding direction in ink-character printing), and the marks M1 and M2 may be printed in a non-information area between the half-cut line and the trailing end of the tape T. However, in such a case, the print direction of the ink-character data must be changed. More specifically, when "braille on bottom" is set, the ink-character data is printed in the inverted position in which it is rotated by 180° (the inverted ink characters P' are printed), as shown in FIG. 14 (a-1). In addition, when "braille on top" is set, the ink-character data is printed in the upright position, as shown in FIG. 14 (a-2). Accordingly, the embossing direction of the braille data is determined by the designated position thereof, while the printing direction of the ink-character data is determined depending on both the designated position thereof and the insertion direction indicated by the insertion mark M1 so that the upper and lower direction of the braille characters matches that of the ink characters P.

In addition, it is not necessary to fix the half-cut position to the position near the leading edge or the trailing edge of the tape T. Alternatively, the half-cut position may be set to the position near the leading edge if the "braille on bottom" is set, and to the position near the trailing edge if the "braille on top" is set. In other words, the printing direction of the ink-character data may be fixed (to the upright position) and the half-cut position may be changed depending on the arrangement.

In addition, although the label-making apparatus 1 includes both the ink-character-printing section 120 and the braille-embossing section 150 according to the preset embodiment (see FIG. 1), the ink-character-printing section 120 and the braille-embossing section 150 may also be structured independently and be connected to each other with an interface (connector). In such a case, an apparatus that functions as the ink-character-printing section 120 (ink-character printing apparatus) can be sold independently, and an apparatus that functions as the braille-embossing section 150 can be attached as an option for those who need to emboss braille characters. In addition, the apparatus that functions as the braille-embossing section 150 can be modified in various ways, and the versatility of the apparatus that functions as the ink-character-printing section 120 can be increased.

In addition, the embossing unit 80 has a size such that three vertically arranged embossing points 201 in a single cell can be processed and includes three embossing pins 41 corresponding to the three embossing points 201. However, the size of the embossing unit 80 may also be set to be large enough to emboss a plurality of lines of braille characters B at the same time. For example, six vertically arranged embossing pins may be provided for embossing two lines of braille characters at the same time. In such a case, the braille-embossing area Eb may be arranged in various ways. When, for example, an embossing unit that can emboss two lines of braille characters simultaneously is used, the embossing pins are preferably divided into two groups, each group including three embossing pins, so that each group can be individually activated and inactivated. More specifically, when an embossing unit that can emboss n lines of braille characters at the same time is used, the embossing pins are preferably divided into n groups so that each group can be individually activated and inactivated. In such a case, tapes T having a width smaller than that of the embossing unit may also be used.

The arrangement of the ink-character printing area Ep and the braille-embossing area Ep is not limited to the examples shown in FIGS. 8A to 8C or the above-described "overlapping arrangement". For example, the ink-character printing area Ep and the braille-embossing area Ep may also be arranged such that they partially overlap each other along the tape width, or be spaced from each other along the tape width. Thus, various layouts may be provided as alternatives. However, also in this case, the position of the braille-embossing area Ep is set adjacent to the sides perpendicular to the width of the tape T (that is, one of the upper and lower sides) and the embossing process is performed on the basis of the designated position and the arrangement of the embossing unit 80.

In the above-described example, the embossing unit 80 that can emboss three embossing points is used. Alternatively, however, two embossing units for respectively embossing the upper and lower areas of the tape T1 may be provided, or the embossing unit 80 may be configured to move along the width of the tape conveying path 70. In such a case, the inversion process of the ink-character data and the braille character data can be omitted.

The above-described components (functions) of the label-making apparatus 1 may also be provided as a program, and the program may be provided in the form of a recording medium (not shown) storing the program. The recording medium may be, for example, compact disk read-only memories (CD-ROM), flash ROM, memory cards (compact-flash® cards, smart media, memory sticks, etc.), compact disks, magneto-optical disks, digital versatile disks, and flexible disks.

In addition, the structure of the label-making apparatus 1 and processes performed by the label-making apparatus 1 are not limited to the above-described embodiment, and various modifications are possible within the scope of the invention. In addition, the invention may be applied not only to label-making apparatuses but also to other various apparatuses that can emboss braille characters.

What is claimed is:

1. An embossing control method used in a braille-embossing apparatus including two discontinuous tape conveying paths, an ink-character tape conveying path and a Braille tape-conveying path, the two discontinuous tape conveying paths include an ink-character printing device that prints an ink character on a tape inserted into the ink character tape conveying path, and an embossing head that embosses a braille string on the tape fed along the braille tape-conveying path, the braille string being embossed in an area biased to one of upper and lower sides of the tape along the width of the tape without changing the upper and lower direction of the braille string, the embossing control method comprising the steps of:

designating the area biased to one of the upper and lower sides of the tape along the width of the tape as a braille-embossing area in which braille embossing is to be performed;

embossing the braille string in the designated braille-embossing area, wherein the embossing head is disposed biased to one of the opposite sides of the braille tape-conveying path along the width of the braille tape-conveying path, the tape being manually inserted into the braille tape-conveying path after the ink character printing device prints information indicating an insertion direction in which the tape is to be inserted into the braille tape-conveying path such that the braille-embossing area of the tape faces the embossing head; and rotating braille data used in braille embossing by 180° along a feeding direction of the tape, after designating the area biased to one of the upper and lower sides of the tape along the width of the tape as the braille-embossing area and before embossing the braille string in the designated braille-embossing area, so that the upper and lower direction of the braille string matches the upper and lower direction of the tape inserted into the Braille tape-conveying path.

2. A computer readable medium having a program stored thereon for executing on a computer the steps according to claim 1.

3. A braille-embossing apparatus including two discontinuous tape conveying paths, the two discontinuous tape conveying paths include an ink-character tape conveying path and a Braille tape-conveying path, an ink-character printing device that prints an ink character on a tape inserted into the ink character tape conveying path, and an embossing head that embosses a braille string on the tape fed along a tape-conveying path, the braille string being embossed in an area biased to one of upper and lower sides of the tape along the width of the tape without changing the upper and lower direction of the braille string, the braille-embossing apparatus comprising:

a designating device that designates the area biased to one of the upper and lower sides of the tape along the width of the tape as a braille-embossing area in which braille embossing is to be performed; and the embossing device that embosses the braille string in the designated braille-embossing area, wherein the embossing head is disposed biased to one of the opposite sides of the tape-conveying path along the width of the tape-conveying path, the tape being manually inserted into the Braille tape-conveying path after the ink character printing device prints information indicating an insertion direction in which the tape is to be inserted into the braille tape-conveying path such that the braille-embossing area of the tape faces the embossing head, and braille data used in braille embossing is rotated by 180° along a feeding direction of the tape, after designating the area biased to one of the upper and lower sides of the tape along the width of the tape as the braille-embossing area and before embossing the braille string in the designated braille-embossing area, so that the upper and lower direction of the braille string matches the upper and lower direction of the tape inserted into the Braille tape-conveying path.

4. A character-information-processing apparatus, comprising:

two discontinuous tape conveying paths including an ink-character tape conveying path and a braille tape-conveying path;

an ink-character printing device that prints an ink character on a tape inserted into the ink-character tape conveying path;

a braille-embossing device that embosses a braille string on the tape manually inserted into the braille tape-conveying path in an area biased to one of upper and lower sides of the tape along the width of the tape; and an area-designating device that designates an arbitrary area along the width of the tape as an ink-character printing area in which ink-character printing is to be performed and the area biased to one of the upper and lower sides of the tape along the width of the tape as a braille-embossing area in which braille embossing is to be performed, wherein the ink-character printing device and the braille-embossing device performing character printing and braille embossing, respectively, in the areas designated by the area-designating device, an embossing head is disposed biased to one of the opposite sides of the tape-conveying path along the width of the tape-conveying path, the tape being manually inserted into the tape-conveying path such that the braille-embossing area of the tape faces the embossing head, and braille data used in braille embossing is rotated by 180° along a feeding direction of the tape, after designating the area biased to one of the upper and lower sides of the tape along the width of the tape as the braille-embossing area and before embossing the braille string in the designated braille-embossing area, so that the upper and lower direction of the braille string matches the upper and lower direction of the tape inserted into the braille tape-conveying path.

5. A character-information-processing apparatus comprising:

two discontinuous tape conveying paths including an ink-character tape conveying path and a braille tape-conveying path;

an ink-character printing device that prints an ink character on a tape inserted into the ink-character tape conveying path;

a braille-embossing device that embosses a braille string on the tape inserted into the braille tape-conveying path in an area biased to one of upper and lower sides of the tape alone the width of the tape; and an area-designating device that designates an arbitrary area along the width of the tape as an ink-character printing area in which ink-character printing is to be performed and the area biased to one of the upper and lower sides of the tape along the width of the tape as a braille-embossing area in which braille embossing is to be performed, wherein the ink-character printing device and the braille-embossing device perform ink-character printing and braille embossing, respectively, in the areas designated by the area-designating device, the braille-embossing device includes an embossing head disposed biased to one of the opposite sides of the braille tape-conveying path along the width of the braille tape-conveying path, the tape being inserted into the braille tape-conveying path such that the braille-embossing area of the tape faces the embossing head, the braille-embossing device rotates braille data used in braille embossing by 180° in accordance with the result of designation performed by the area-designating device so that the upper and lower direction of the braille string matches the upper and lower direction of the tape inserted into the braille tape-conveying path, the tape is manually inserted into the braille tape-conveying path after ink-character printing, and the ink-character printing device prints information indicating an insertion direction in which the tape is to be inserted into the braille tape-conveying path and rotates ink-character data used in ink-character printing by 180° in accordance with the insertion direction and the result of designation performed by the area-designating device so that the upper and lower direction of the braille sting matches the upper and lower direction of the ink-character string.

* * * * *